US006095221A

United States Patent [19]

Frey, Jr.

[11] Patent Number: 6,095,221

[45] Date of Patent: Aug. 1, 2000

[54] AWNING EXTENSION AND RETRACTION MECHANISM

[75] Inventor: Sydney W. Frey, Jr., Brookfield, Wis.

[73] Assignee: White Consolidated Industries, Inc., Cleveland, Ohio

[21] Appl. No.: 09/137,201

[22] Filed: Aug. 20, 1998

[51] Int. Cl.[7] ..... E04F 10/06

[52] U.S. Cl. ..... 160/67; 160/69; 135/88.12

[58] Field of Search ..... 160/65, 66, 67, 160/69, 70, 78, 72, 81, 59; 135/88.11, 88.12

[56] References Cited

U.S. PATENT DOCUMENTS

| | | | |
|---|---|---|---|
| 328,921 | 10/1885 | Cook . | |
| 415,102 | 11/1889 | Fullerton . | |
| 500,741 | 7/1893 | Giessenbier . | |
| 530,098 | 12/1894 | Fautex . | |
| 602,772 | 4/1898 | Richards . | |
| 918,598 | 4/1909 | Rothchild . | |
| 924,951 | 6/1909 | Winberg . | |
| 1,246,601 | 11/1917 | Howe . | |
| 1,620,958 | 3/1927 | Girton et al. . | |
| 1,742,437 | 1/1930 | Davenport . | |
| 1,854,499 | 4/1932 | Anton et al. | 160/65 |
| 1,856,161 | 5/1932 | Heiser | 160/70 |
| 1,865,083 | 6/1932 | Christian . | |
| 1,977,114 | 10/1934 | Chitwood . | |
| 2,107,676 | 2/1938 | Neumann . | |
| 2,215,179 | 9/1940 | Hyland | 160/65 |
| 3,847,171 | 11/1974 | Akers et al. . | |
| 4,160,458 | 7/1979 | Marcellus . | |
| 4,180,117 | 12/1979 | Greer | 160/67 |
| 4,373,707 | 2/1983 | Molders . | |
| 4,615,371 | 10/1986 | Clauss . | |
| 4,623,132 | 11/1986 | Smith . | |
| 4,719,954 | 1/1988 | Curtis et al. . | |
| 4,836,263 | 6/1989 | Ament . | |
| 4,909,488 | 3/1990 | Seibert et al. . | |
| 5,148,848 | 9/1992 | Murray et al. . | |
| 5,292,169 | 3/1994 | O'Brian . | |
| 5,307,856 | 5/1994 | Murray . | |
| 5,369,919 | 12/1994 | Lohausen . | |
| 5,597,006 | 1/1997 | Simonetti . | |
| 5,813,424 | 9/1998 | Simonetti . | |

FOREIGN PATENT DOCUMENTS

| | | | |
|---|---|---|---|
| 582427 | 8/1933 | Germany | 160/65 |
| 27 36 721 | 2/1978 | Germany | E04F 10/06 |
| 694619 | 9/1968 | Italy . | |
| 7703999 | 4/1977 | Netherlands | E04F 10/06 |
| 55187 | 9/1938 | United Kingdom | 160/69 |
| 2 050 154 | 1/1981 | United Kingdom | A61G 7/10 |
| 2 055 154 | 1/1981 | United Kingdom | A61G 7/10 |

*Primary Examiner*—Blair M. Johnson
*Attorney, Agent, or Firm*—Pearne, Gordon, McCoy & Granger LLP

[57] ABSTRACT

An awning includes a roller assembly having a torsion spring, a canopy connected between a wall the roller assembly, and a pair of "four-bar" arm assemblies supporting opposite ends of the roller assembly. The arm assemblies move the roller assembly between a retracted position and an extended position, where the torsion spring biases the roller assembly toward the retracted position. Each arm assembly includes a vertically extending base arm secured to the wall, a bottom arm having a first end pivotally connected to the base arm, an extended arm having a first end pivotally connected to the bottom arm and a second end supporting the roller assembly, and a top arm having a first end pivotally connected to the base arm and a second end pivotally connected to the extended arm. The base arm has a telescoping extension so that the effective length of the base arm is variable. Each arm assembly also includes a force producing member extending between the base arm and the bottom or top arm to move the arm assembly toward the extended position. In a preferred powered automatic awning, the force producing member is an electric linear actuator extending between the base arm and the bottom arm. A counter-balance spring biases the arm assembly toward the extended position to counter-balance the torsion spring. In a preferred spring-assisted manual awning, a tension coil spring extends between the base arm and the bottom arm to counter-balance the torsion spring, or a compression spring suitably mounted to create tension between the base arm and the bottom arm. In another preferred spring-assisted manual awning, a compression gas spring extends between the base arm and the top arm to counter-balance the torsion spring.

31 Claims, 13 Drawing Sheets

FIG. 1
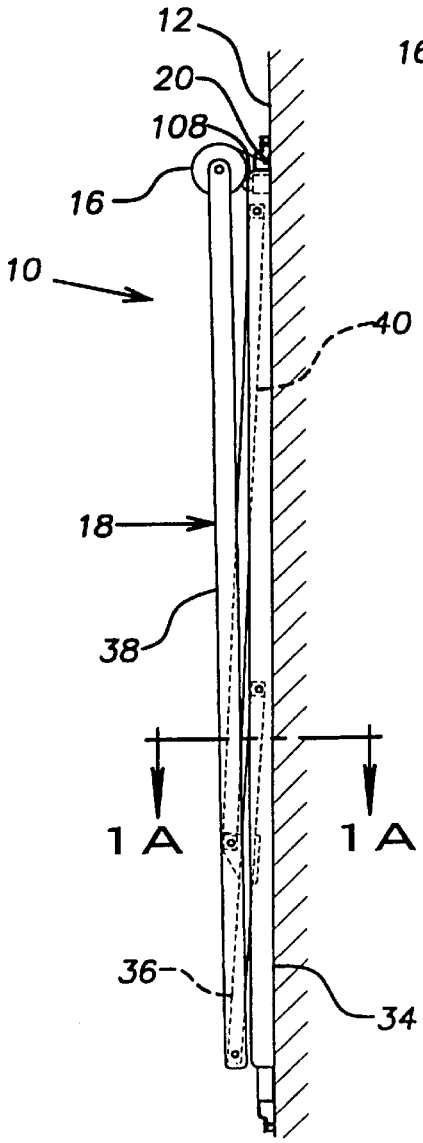
FIG. 2
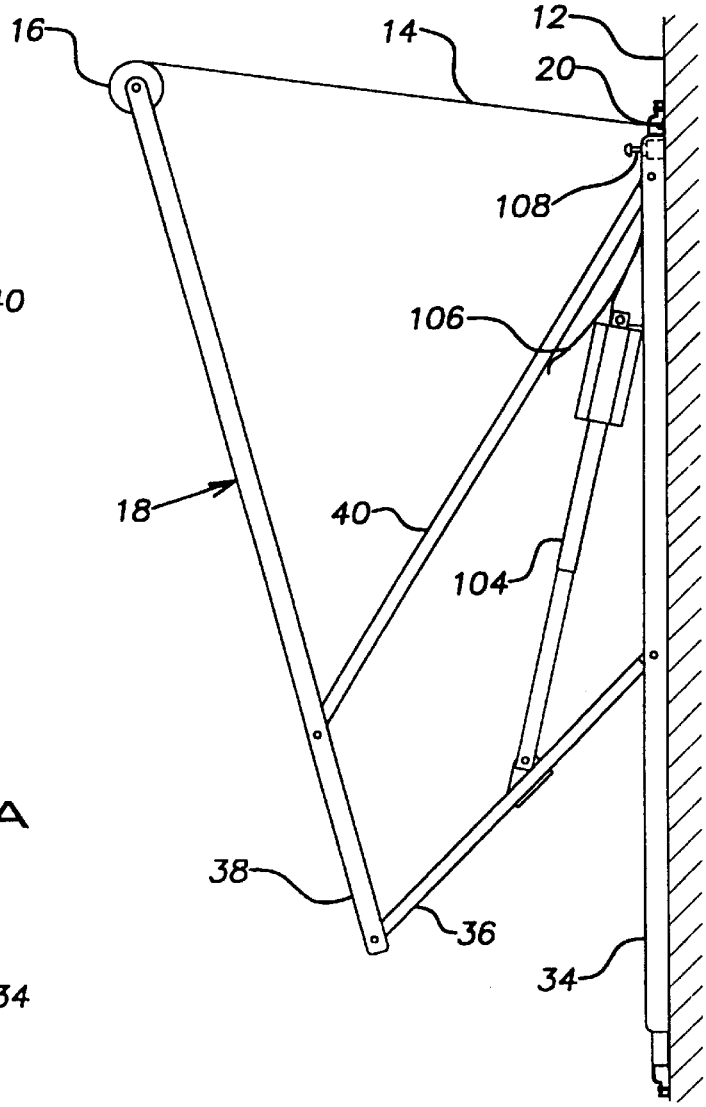
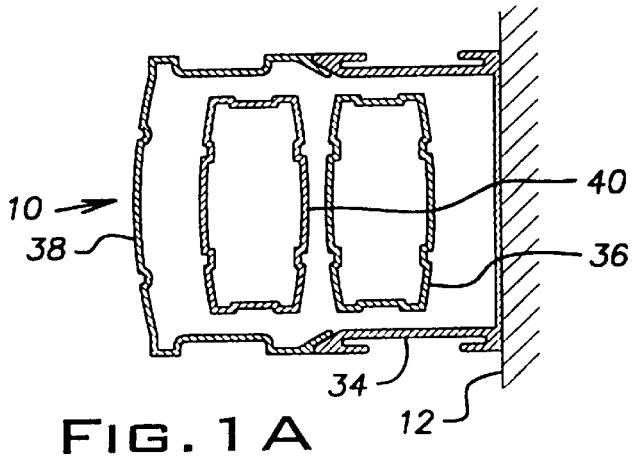
FIG. 1A 64
68
66
69
102
98
86
98
102
90
38
94
72
18
40
70
74
76
74
56
76
36
62
58
60
54
60
62
120
106
100
88
96
84
96
100
132
108
130
34
50
48
52
59
46
43
92
47
50
112
114
104
118
116

112
142
116

18
40
38
66
68
69
86
90
70
56
36
116
142
54
146
44
42
119
34
47
180
84
46
48
88
112
144
58
43
45
51
50

FIG. 19
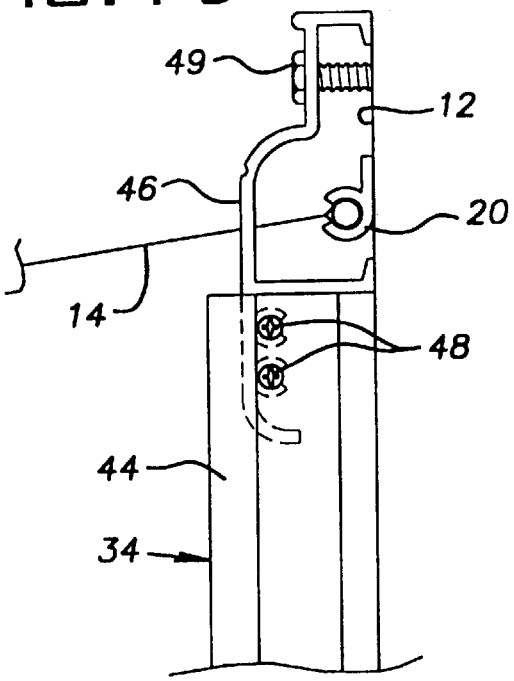
FIG. 20
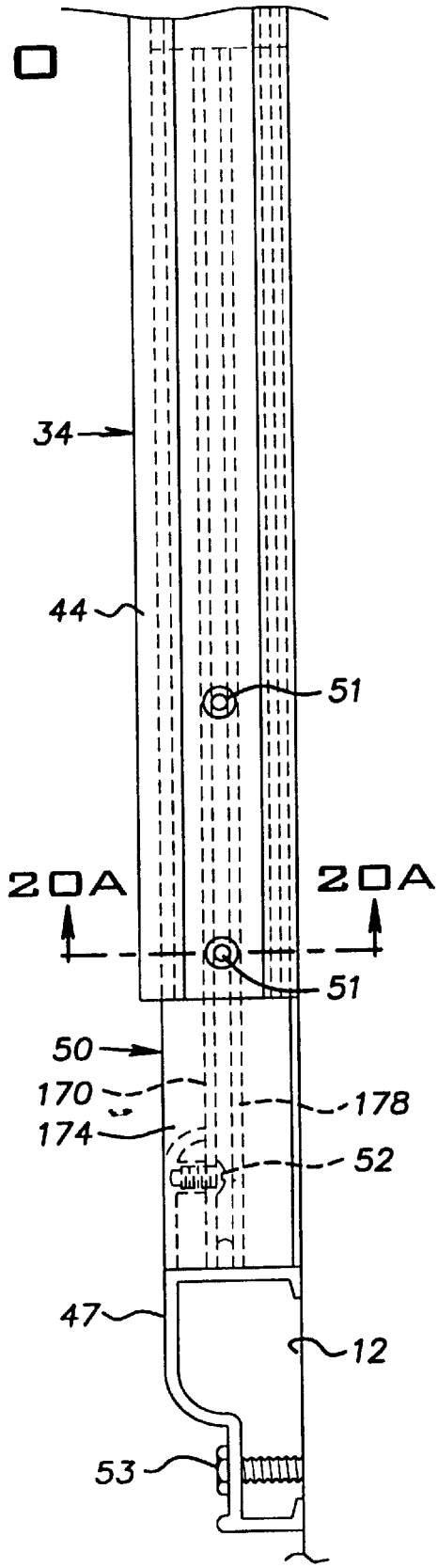
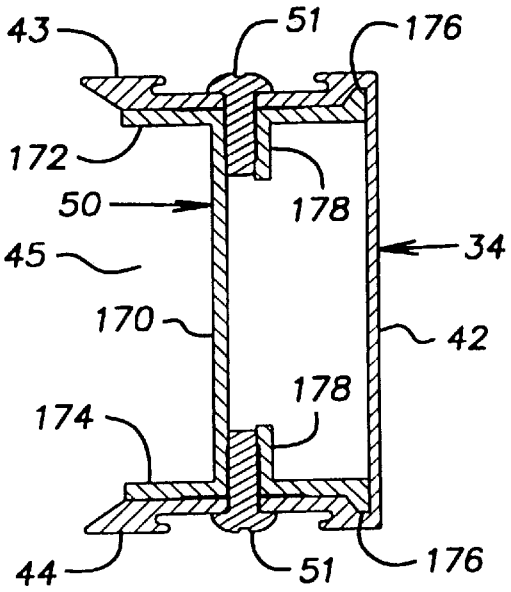
FIG. 20A

AWNING EXTENSION AND RETRACTION MECHANISM

BACKGROUND OF THE INVENTION

The present invention generally relates to retractable awnings of the type to be mounted to a substantially vertical support surface and, more specifically, to such awnings which have powered automatic operation or assisted manual operation.

There are a number of known retractable awnings that support an awning or canopy to create a sheltered area. An inner end of the canopy is typically secured to a wall and an outer end of the canopy is typically secured to a roller assembly. The roller assembly is supported at its ends by support arms for movement between a retracted position, wherein the roller assembly is disposed adjacent the wall, and an extended position, wherein the roller assembly is extended out away from the wall. When the roller assembly is in the retracted position, the canopy is rolled-up on the roller assembly. When the roller assembly is in the extended position, the canopy is unrolled from the roller assembly and extends between the wall and the roller assembly. These retractable awnings are often designed for use with movable support structures such as, for example, recreational vehicles, travel trailers, mobile homes, and the like, but are also usable with fixed structures.

While these prior awning assemblies may adequately perform their intended functions, they are often difficult to deploy and retract due to their heavy weight, complex operation and numerous operational steps, particularly for elderly and physically challenged individuals. To overcome this problem, automatic awnings and assisted manual awnings have been developed. See U.S. Pat. Nos. 5,597,006 and 4,160,458, and 3,847,171, for example, each disclosing powered mechanisms for automatically operating a retractable awning. See U.S. Pat. No. 5,148,848, for example, disclosing a spring-assist mechanism for a retractable awning. While these mechanisms may some what improve operation, each is still relatively difficult to operate, is difficult and expensive to manufacture or repair, and/or is unreliable in the field. Accordingly, there is a need in the art for an improved retractable awning which has powered automatic operation or assisted manual operation.

BRIEF SUMMARY OF THE INVENTION

The present invention provides a retractable awning which overcomes at least some of the above-noted problems of the related art. According to the present invention, the awning includes a roller assembly, a flexible canopy having an inner edge for connection to a wall and an outer edge secured to the roller assembly, and a pair of arm assemblies supporting opposite ends of the roller assembly. The arm assemblies are operable to move the roller assembly between a retracted position adjacent the wall and an extended position spaced from the wall. Each arm assembly includes a vertically extending base arm for connection to the wall, a bottom arm having a first end pivotally connected to the base arm, an extended arm having a first end pivotally connected to the bottom arm and a second end connected to and supporting the roller assembly, and a top arm having a first end pivotally connected to the base arm above the bottom arm and a second end pivotally connected to the extended arm. Each arm assembly also includes a force producing member extending between the base arm and one of the bottom arm or the top arm which outwardly pivots the bottom arm, the extended arm, and the top arm toward the extended position.

According to a first preferred embodiment of the present invention, the force producing member is a powered actuator which automatically extends and retracts the awning. The powered actuator preferably extends between the base arm and the bottom arm. The powered actuator is preferably an electric linear actuator.

According to a second preferred embodiment of the present invention, the force producing member is a tension spring which assists in manual operation of the awning. The tension spring extends between the base arm and the bottom arm. The tension spring can be a coil spring.

According to a third preferred embodiment of the present invention, the force producing member is a compression spring which assists in manual operation of the awning. The compression spring extends between the base arm and the top arm. The compression spring is preferably a gas spring.

According to another aspect of the present invention, a retractable awning includes a roller assembly having a torsion spring, a flexible canopy having an inner edge for connection to a wall and an outer edge secured to the roller assembly, and a pair of arm assemblies supporting opposite ends of the roller assembly. The arm assemblies are operable to move the roller assembly between a retracted position adjacent the wall and an extended position spaced from the wall. The torsion spring of the roller assembly biases the roller assembly toward the retracted position. Each arm assembly includes a vertically extending base arm for connection to the wall, a bottom arm having a first end pivotally connected to the base arm, an extended arm having a first end pivotally connected to the bottom arm and a second end connected to and supporting the roller assembly, and a top arm having a first end pivotally connected to the base arm above the bottom arm and a second end pivotally connected to the extended arm. Each arm assembly also includes a counter-balance spring biasing the arms toward the extended position and at least partially counter-balancing forces produced by the torsion spring. Preferably, the counter-balance spring is a leaf spring located between the base arm and the top arm which biases the top arm toward the extended position. The counter-balance spring is primarily needed when the awning approaches the wall where the awning has mechanical advantage over a powered actuator.

According to yet another aspect of the present invention, a retractable awning for mounting to a wall includes a roller assembly, a flexible canopy having an inner edge for connection to the wall and an outer edge secured to the roller assembly, and a pair of arm assemblies supporting opposite ends of the roller assembly. The arm assemblies are operable to move the roller assembly between a retracted position adjacent the wall and an extended position spaced from the wall. Each of the arm assemblies includes a vertically extending base arm for connection to the wall, a bottom arm having a first end pivotally connected to the base arm, an extended arm having a first end pivotally connected to the bottom arm and a second end connected to and supporting the roller assembly, a top arm having a first end pivotally connected to the base arm above the bottom arm and a second end pivotally connected to the extended arm, and a base arm extension telescopically cooperating with the base arm. The base arm extension permits a combined length of the base arm and the base arm extension, which is the effective length of the base arm, to be adjustable so that the base arm can be easily secured to walls of having different heights.

BRIEF DESCRIPTION OF THE SEVERAL VIEWS OF THE DRAWING

These and further features of the present invention will be apparent with reference to the following description and drawings, wherein:

FIG. 1 is a side elevational view of a powered automatic awning according to the present invention in a stored or retracted position;

FIG. 1A is an enlarged cross-sectional view taken along line 1A—1A of FIG. 1;

FIG. 2 is a side elevational view of the awning of FIG. 1 in a partially deployed or extended position;

FIG. 19 is an enlarged elevational view of the upper end of a base arm of the awning of FIG. 3;

FIG. 20 is an enlarged elevational view of the lower end of the base arm of the awning of FIG. 3;

FIG. 20A is an enlarged cross-sectional view taken along line 20A—20A of FIG. 20;

DETAILED DESCRIPTION OF PREFERRED EMBODIMENTS

Figures 3, 3A, 3B:
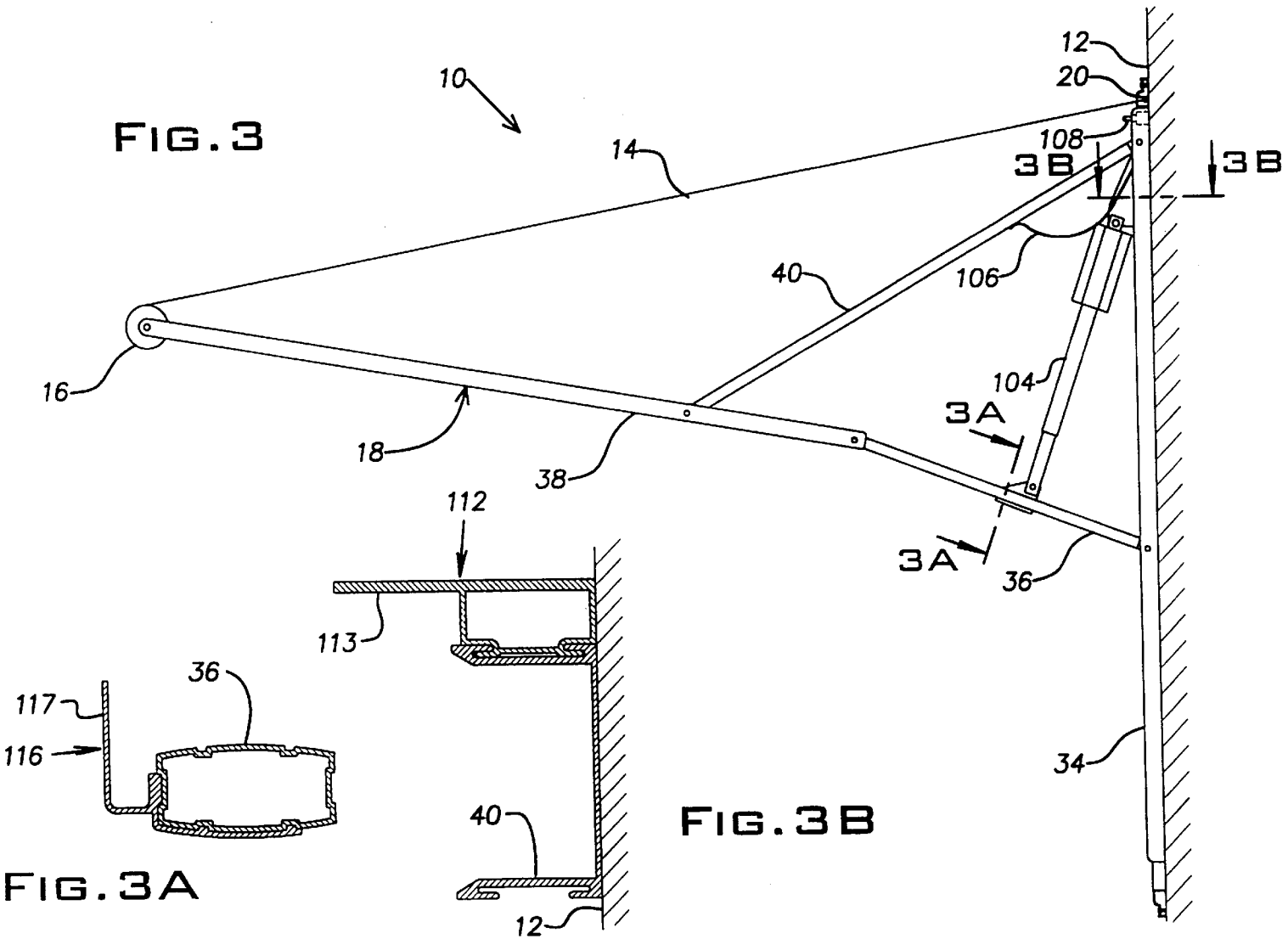
FIG. 3 is a side elevational view of the awning of FIGS. 1 and 2 in a fully deployed or extended position.
FIG. 3A is an enlarged cross-sectional view taken along line 3A—3A of FIG. 3.
FIG. 3B is an enlarged cross-sectional view taken along line 3B—3B of FIG. 3.

FIGS. 1 to 3 illustrate a first embodiment of a retractable awning 10 according to the present invention. The awning 10 is a powered automatic awning which is attached to a vertically-extending support wall 12 such as a side of a recreational vehicle. The term "recreational vehicle", as used in the specification and claims, includes campers, travel trailers, mobile homes, vans, buses, and the like. While the awning 10 is particularly advantageous when attached to recreational vehicles, it can alternatively be attached to other vertically-extending walls such as, for example, the side of a building at a patio or deck or any other transportable or fixed structure.

The awning 10 is automatically operable between a retracted or stored position (shown in FIG. 1) and an extended or sheltering position (shown in FIG. 3). In the retracted position, the awning 10 is in a compact configuration close to the side support wall 12 of the recreational vehicle so that the recreational vehicle can travel to desired destinations with minimum side projections (best shown in FIG. 1A). After a destination is reached, the awning 10 is deployed from the retracted position to the extended position if a covered area is desired to protect against sun, rain, and the like.

The awning 10 includes an awning or canopy 14 for selectively covering an area adjacent to the wall 12, a roller assembly 16 for furling and unfurling the canopy 14, and right and left arm assemblies 18 for supporting opposite ends of the roller assembly 16.

The canopy 14 is a sheet of flexible material such as, for example, fabric, canvas, acrylic, or nylon and is preferably rectangularly shaped. The inner or top edge of the canopy 14 is secured to the support wall 12 and the outer or bottom edge of the canopy 14 is secured to the roller assembly 16. The inner and outer edges of the canopy 14 are preferably provided with an awning rope or other suitable cylindrical member. The awning rope is preferably a polypropylene rope and is preferably sewn in a hem or pocket formed at the edges of the canopy 14.

The rope at the inner edge of the canopy 14 is preferably held by an awning rail 20 which horizontally extends along the support wall 12 and is rigidly secured to the support wall 12 by suitable fasteners. The awning rail 20 is preferably an aluminum extrusion having a channel formed therein for retaining the awning rope in a known manner. It is noted that the inner edge of the canopy 14 can be alternately secured to the support wall 12 in other manners such as, for example, directly to the support wall 12 or to a cover attached to the wall 12. The awning rope at the outer edge of the canopy 14 is held by the roller assembly 16 as described in more detail hereinafter.

Figure 4:
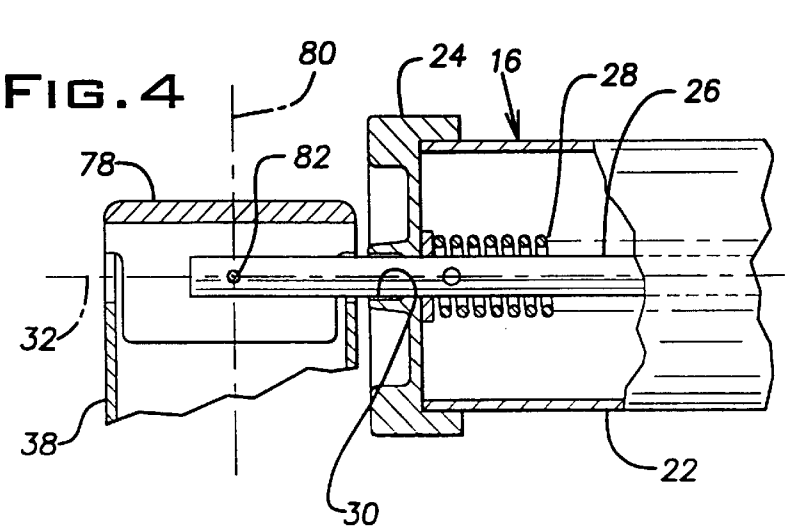
FIG. 4 is an enlarged and fragmented elevational view, partially in cross-section, showing the end of a roller assembly of the awning assembly of FIG. 1.

As best shown in FIG. 4, a suitable roller assembly 16 includes a roller tube 22, a pair of end caps 24 closing open ends of the roller tube 22, axles or bars 26 which rotatably support the roller tube 22, and at least one torsion spring 28. The roller tube 22 preferably has longitudinally extending channels or grooves formed therein so that the awning rope of the outer edge of the canopy 14 is secured to one of the grooves in a known manner.

Each end cap 24 is rigidly secured to the roller tube 22 for rotation therewith and has a central opening 30 therein. The bar 26 extends through the central opening 30 such that the roller tube 22 and the end cap 24 are free to rotate together with respect to the bar 26. The bars 26 form a rotational axis 32 for the roller tube 22 and support the roller tube 22. The torsion spring 28 is disposed around the bar 26 within the roller tube 22. The torsion spring 28 is operably connected between the roller tube 22 and the bar 26 in any known manner so that rotation of the roller tube 22 with respect to the bars 26 varies tension of the torsion spring 28. The torsion spring 28, therefore, can be advantageously preloaded for biasing the roller tube 22 to roll-up the canopy 14 onto the roller tube 22. Biased in this manner, the torsion spring 28 both tensions the canopy 14 when the awning 10 is held in the extended position and furls the canopy 14 onto the roller tube 22 when the awning 10 is moved from the extended position to the retracted position. It is noted that other configurations of roller assemblies and/or tensioning mechanisms can be utilized within the scope of the present invention.

The roller assembly 16 can also include a lock and release mechanism for selectively preventing rotation of the roller tube 22 in one direction or the other. The lock mechanism can be of any suitable type. See, for example, U.S. Pat. No. 5,732,756, disclosing a suitable lock mechanism for the roller assembly 16. It should be noted that the lock mechanism is optional for the powered automatic awning and is generally not required because the arm assemblies 18 hold the roller assembly 16 in position as described in more detail hereinafter.

The bars 26 of the roller assembly 16 are supported by the arm assemblies 18. Each arm assembly 18 is disposed in a generally vertical plane at an associated side edge of the canopy 14 and an associated end of the roller assembly 16. The left and right arm assemblies 18 have essentially identical structures and therefore only one will be described in detail hereinafter.

Figure 5:
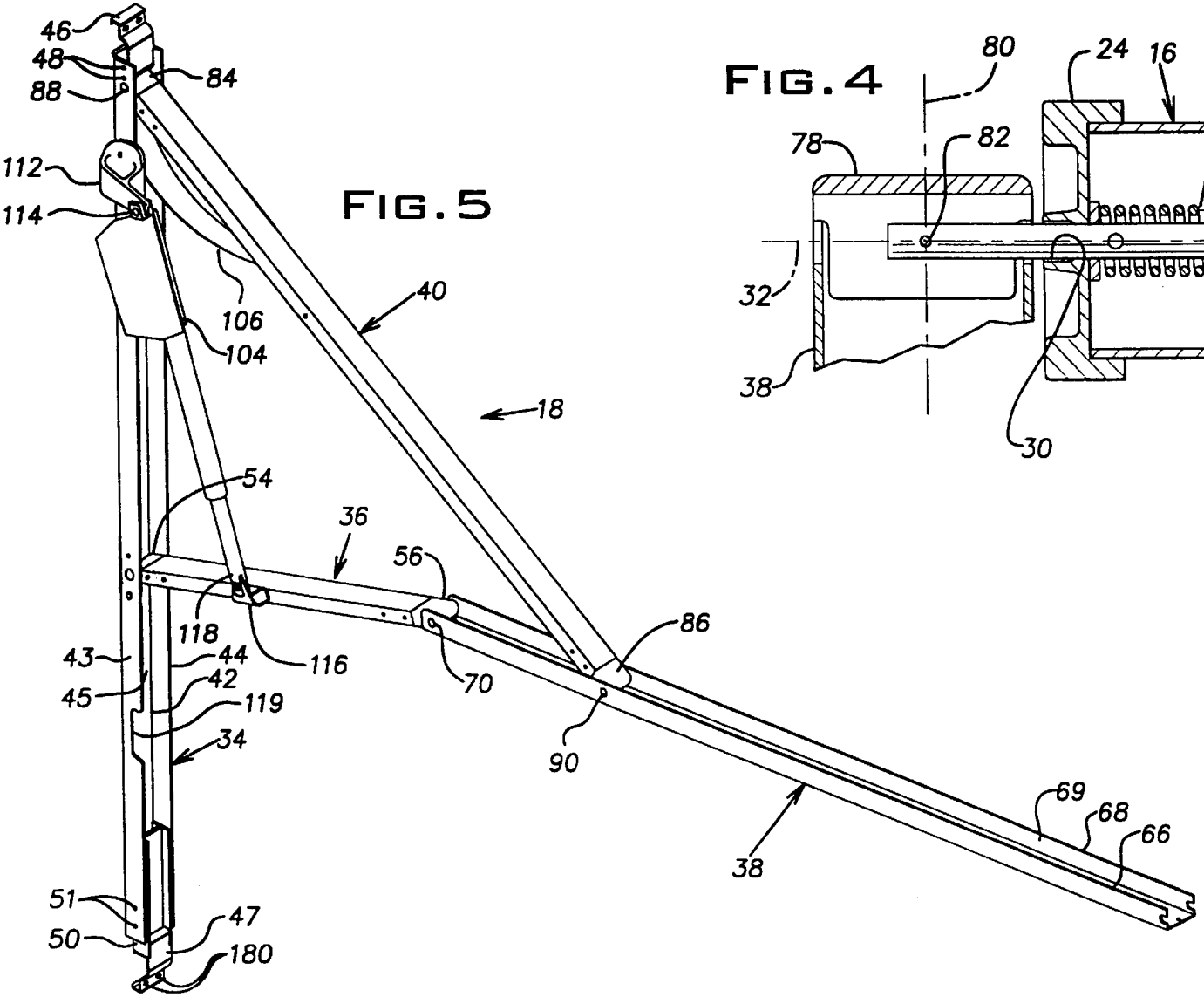
FIG. 5 is an enlarged perspective view of an automatic arm assembly of the awning assembly of FIGS. 1 to 3 in the fully extended position.
Figure 6:
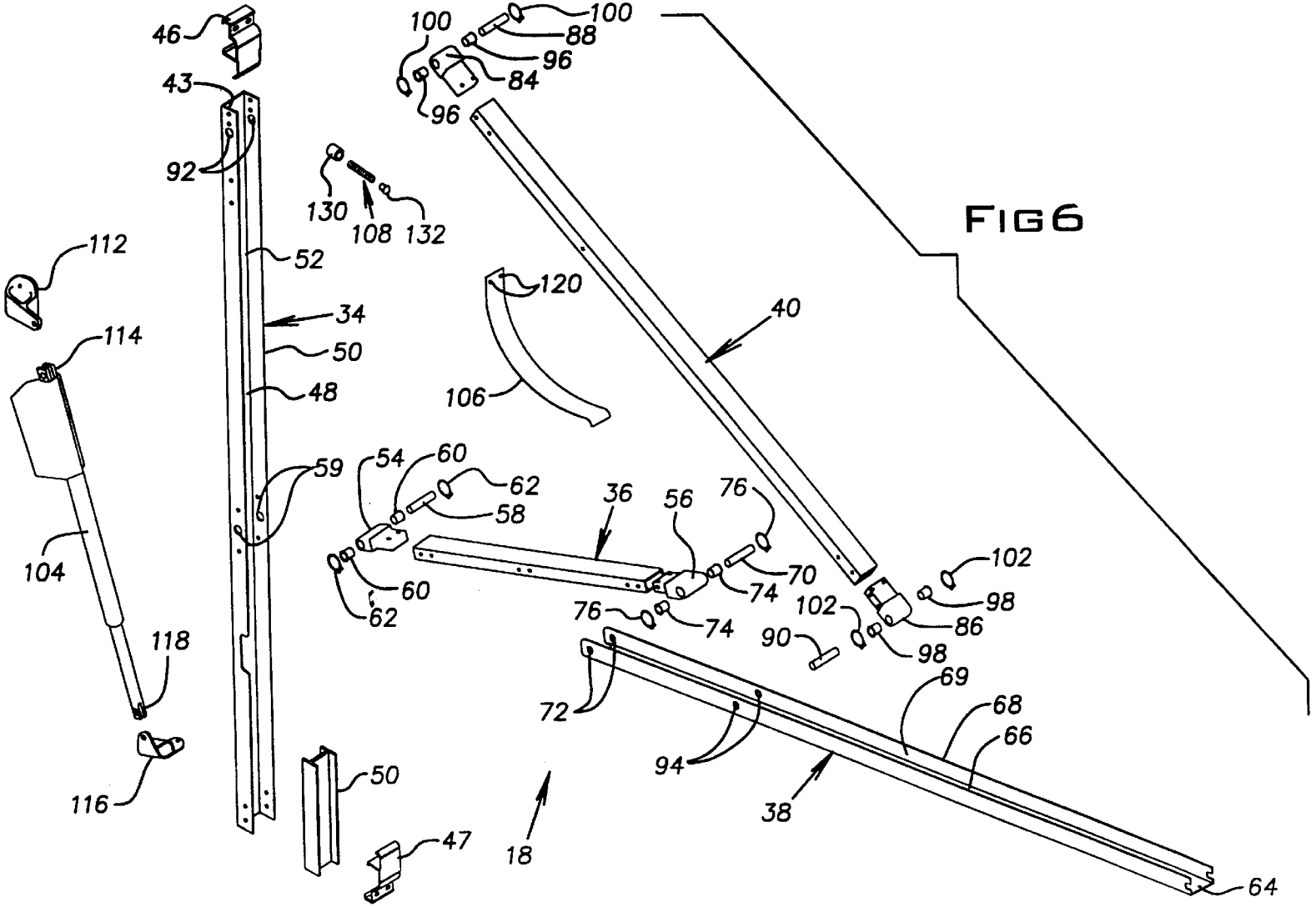
FIG. 6 is an exploded view of the arm assembly of FIG. 5.

As best shown in FIGS. 5 and 6, each arm assembly 18 is a four bar linkage including a first or base arm 34, a second or bottom arm 36, a third or extended arm 38, and a fourth or top arm 40. Each of the arms 34, 36, 38, 40 are substantially straight and elongate and are fixed in length. The arms 34, 36, 38, 40 are preferably extrusions of a light weight, high strength material such as an aluminum alloy.

The base arm 34 has a main wall 42 and inner and outer side walls 43, 44 which perpendicularly extend from opposed side edges of the main wall 42 to form a vertically extending and outward facing channel 45. The channel 45 is outward facing so that it at least partially receives the top and bottom arms 36, 40 when in the retracted position (see FIGS. 1 and 1A).

The base arm 34 is rigidly secured to the support wall 12, preferably with top and bottom mounting brackets 46, 47. The mounting brackets 46, 47 are preferably extrusions of a light weight, high strength material such as an aluminum alloy.

As best shown in FIG. 19, the top mounting bracket 46 extends from the open upper end of the base arm 34. At the upper end of the base arm 34, the side walls 43, 44 are provided with openings for cooperating threaded fasteners 48 to rigidly attach the top mounting bracket 46 to the base arm 34. The top mounting bracket 46 is preferably formed for receiving the threaded fasteners 48. The top mounting bracket 46 has an inwardly extending top flange or hook member at an upper end thereof which can be advantageously located at a top rail of a recreational vehicle when the awning 10 mounted thereto. The top mounting bracket 46 is also provided with openings below the top flange for cooperating with threaded fasteners 49 to rigidly secure the top mounting bracket 46 to the support wall 12.

Figures 21, 22:
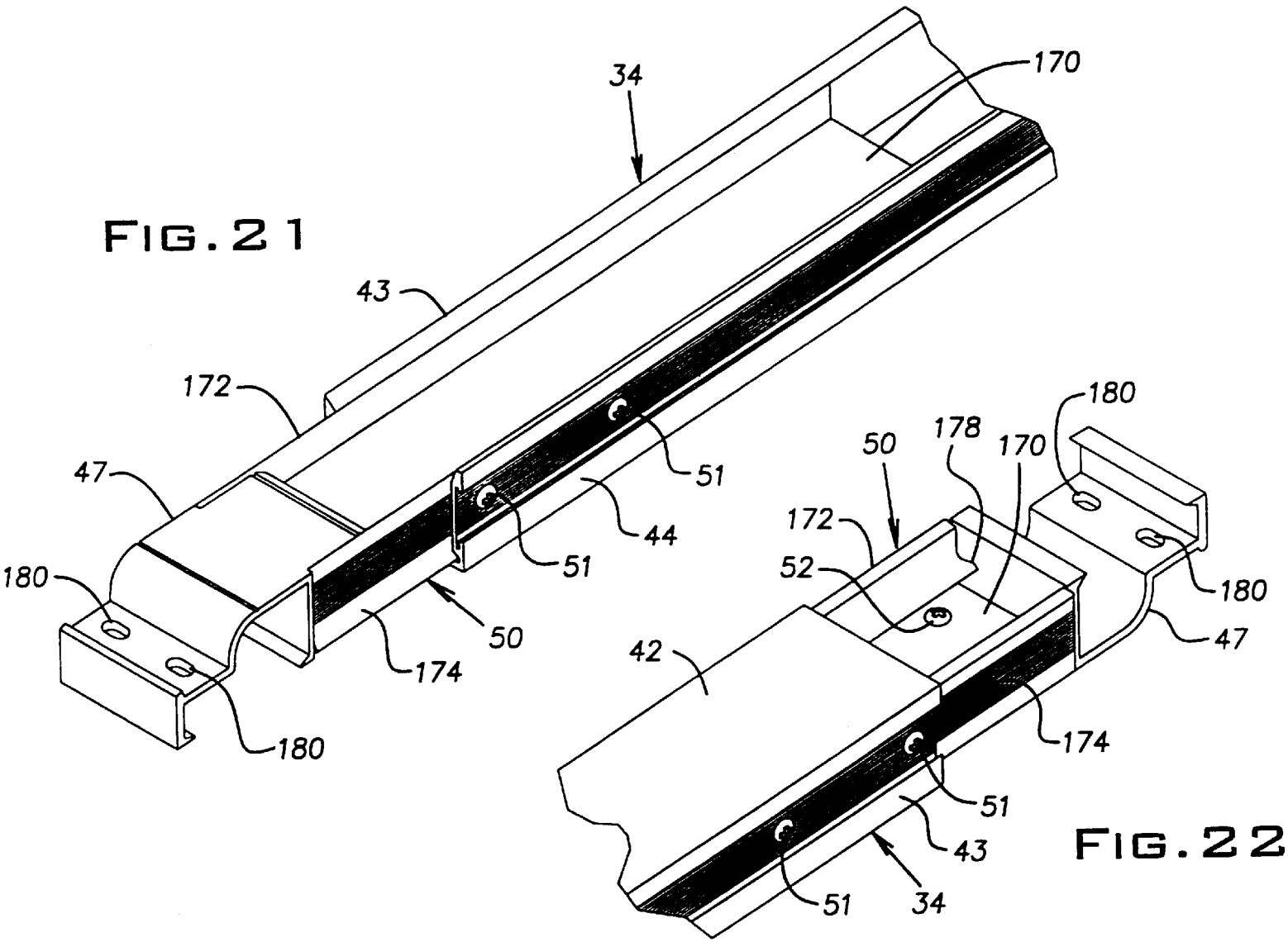
FIG. 21 is a front perspective view of the lower end of the base arm.
FIG. 22 is a rear perspective view of the lower end of the base arm.

As best shown in FIGS. 20–22, the lower end of the base arm 34 is preferably provided with a base arm extension 50. The base arm extension 50 is substantially straight and elongate and is fixed in length. The base arm extension 50 cooperates with the base arm 34 so that the distance between the top and bottom mounting brackets 46, 47, which is the effective length of the base arm 34, is variable as described in more detail hereinafter. The base arm extension 50 is preferably an extrusion of a light weight, high strength material such as an aluminum alloy.

The base arm extension 50 preferably has a generally H-shaped cross-section formed by a main wall 170 and inner and outer side walls 172, 174 which perpendicularly extend from ends the main wall 170. The base arm extension 50 is sized to fit within the channel 45 of the base arm 34 so that it can longitudinally move therein in a telescoping manner. Outwardly directed protrusions 176 are provided at the base of the side walls 172, 174 which longitudinally extend along the length of the base arm extension 50. The protrusions are 176 sized and shaped to cooperate with undercuts or grooves formed in the side walls 43, 44 of the base arm 34 to interlock the base arm 34 and the base arm extrusion 50 together. Secured in this manner, the base arm 34 and the base arm extension are interlocked to together in a drawer-like manner such that they can only move longitudinally relative to one another.

At the lower end of the base arm 34, the side walls 43, 44 are provided with openings for cooperating threaded fasteners 51 to rigidly attach the base arm extension 50 to the base arm 34. The side walls 172, 174 of the base arm extension 50 are preferably provided with inwardly directed flanges 178 which longitudinally extend along the length of the base arm extension 50. The flanges 178 are inwardly spaced apart from the main wall 170 to receive and secure the threaded fasteners 51 therebetween. The side walls of the base arm extension 50 can be provided with a plurality of longitudinally spaced-apart openings so that the position of base arm extension 50 relative to the base arm 34 can be adjusted to a plurality of positions. For example, there can be about six openings spaced-apart along intervals of about 1 to about 1.5 inches. Alternatively, the openings in the base arm extension side walls 172, 174 can be custom drilled during installation using the openings in the base arm side walls 43, 44 as pilots once the base arm extension 50 has been located in its desired position relative to the base arm 34. It is noted that drilling the openings during installation provides infinite adjustability of the base arm extension 50. It is also noted that the openings can be formed using self-drilling fasteners if the base arm extension 50 is formed of a suitable material.

The bottom mounting bracket 47 extends from the lower end of the base arm extension 50. At the lower end of the base arm extension 50, the main wall is provided with openings for cooperating threaded fasteners 52 to rigidly attach the bottom mounting bracket 47 to the base arm extension 50. The bottom mounting bracket 47 is preferably formed for receiving the threaded fasteners 52. The bottom mounting bracket 47 also an upwardly directed protrusion sized and shaped to cooperate with the main wall 170 and flanges 178 of the base wall extension 150. The protrusion extends between the main wall 170 and the flanges to interlock the bottom mounting bracket 47 and the base arm extension 50. The bottom mounting bracket 47 has an inwardly extending bottom flange or hook member at an lower end thereof which can be advantageously located at the box iron of a recreational vehicle when the awning 10 is mounted thereto. The bottom mounting bracket 47 is also provided with openings 180 for cooperating with threaded fasteners 53 to rigidly secure the bottom mounting bracket 47 to the support wall 12.

It can be seen from the above description that the overall length of the base arm and base arm extension can be easily adjusted in a telescoping manner. Therefore, the awning 10 can be easily secured to support walls 12 having various dimensions such as a variety of different recreational vehicles.

As best shown in FIGS. 5 and 6, the bottom arm 36 has an inner end pivotally mounted to a central or intermediate portion of the base arm 34. The bottom arm 36 is preferably tubular in cross-section and is provided with inner and outer end caps or plugs 54, 56 secured to and closing the open inner and outer ends of the bottom arm 36 respectively. The end caps 54, 56 are secured to the bottom arm in any suitable manner such as, for example, rivets or screws. The inner end cap 54 is provided with an opening for receiving a pivot shaft 58 therethrough. The pivot shaft 58 extends through the inner end cap 54 and openings 59 in the side walls 43, 44 of the base arm 34 to form a pivot joint or rotatable connection therebetween. The pivot shaft 58 is preferably provided with suitable bearings 60, such as the illustrated flanged sleeve bearings, and is preferably held in position by retaining rings 62. The inner end cap 54 is optionally biased to a central position within the channel of the base arm 34 by spring washers located between the side walls 43, 44 of the base arm 34 and flanges of the bearings 60.

The extended arm 38 has an inner or lower end pivotally mounted to an outer or lower end of the bottom arm 36 and an outer or upper end connected to the end of the roller assembly 16 (best shown in FIG. 5). The extended arm 38 is preferably channel-shaped in cross-section having a main wall 64 and inner and outer side walls 66, 68 perpendicularly extending from opposed side edges of the main wall 64 to form a channel 69. The channel 69 preferably faces upward when the awning 10 is extended so that it at least partially receives the bottom arm 36 therein when in the retracted or stored position (see FIGS. 1 and 1A).

The outer end cap 56 of the bottom arm 36 is provided with an opening for receiving a pivot shaft 70 therethrough. The pivot shaft 70 extends through the outer end cap 56 and openings 72 in the side walls 66, 68 of the extended arm 38 to form a pivot joint or rotatable connection therebetween. The pivot shaft 70 is preferably provided with suitable bearings 74, such as the illustrated flanged sleeve bearings, and is preferably held in position by suitable retaining rings 76. The outer end cap 56 is optionally biased to a central position within the channel of the extended arm 38 by spring washers located between the side walls 66,68 of the extended arm 38 and flanges of the bearings 74.

As best shown in FIG. 4, the upper or outer end of the extended arm 38 supports the roller assembly 16. The free end of the extended arm 38 is provided with an upper end cap 78 which has a socket into which the upper end of the support arm 38 is closely received and rigidly secured. The upper end cap 78 is preferably secured to the extended arm 38 by rivets, but can be alternatively secured in other manners.

The upper end cap 78 and the roller assembly bar 26 are preferably secured together in a manner which allows rotation of the bar 26, relative to the upper end cap 78, about only one axis which facilitates handling and misalignment. The bar 26 cannot rotate about the rotational axis 32 or the longitudinal axis 80 of the extended arm 38. The bar 26 can, however, rotate about a pivot axis which is substantially perpendicular to both the pivot axis 32 and the longitudinal axis 80 of the extended arm 38 at the outer or upper end of the extended arm 38. In the illustrated embodiment the pivot axis is formed by a pin 82 which extends through the bar 26 and the upper end cap 78. The bar 26 and the upper end cap 78, however, can be alternately joined in other suitable manners such as, for example, by a screw or tube rivet.

The top arm 40 has an inner or upper end pivotally mounted to an upper portion of the base arm 34 and an outer or lower end pivotally mounted to an intermediate portion of the extended arm 38 generally near the lower or inner end of the extended arm 38. The top arm 40 is preferably tubular in cross-section and preferably has inner and outer end caps or plugs 84, 86 secured to and closing the open inner and outer ends of the top arm respectively. The inner and outer end caps 84, 86 are each provided with an opening for receiving a pivot shaft 88, 90 therethrough. One pivot shaft 88 extends through the inner end cap 84 and openings 92 in the side walls 43, 44 of the base arm 34 to form a pivot joint or rotatable connection therebetween. The other pivot shaft 90 extends through the outer end cap 86 and openings 94 in the side walls 66, 68 of the extended arm 38 to form a pivot joint or rotatable connection therebetween. The pivot shafts 88, 90 are each preferably provided with suitable bearings 96, 98, such as the illustrated flanged sleeve bearings, and are preferably held in position by suitable retaining rings 100, 102. The inner end cap 84 is optionally biased to a central position within the channel of the base arm 34 by spring washers located between the side walls 43, 44 of the base arm 34 and flanges of the bearings 96. The outer end cap 86 is optionally biased to a central position within the channel of the extended arm 38 by spring washers located between the side walls 66, 68 of the extended arm 38 and flanges of the bearings 98.

It is this system of pivotally attached bars or arms 34, 36, 38, 40 which form a four-bar linkage that provides a support base which reaches out to support the roller assembly 16 and fold backs into a compact stack against the wall 12, by stacking the tubular-shaped arms 36, 40 within the channel-shaped arms 34, 38.

Each arm assembly 18 also includes a force producing member for outwardly pivoting the bottom arm 36 toward the extended position. In the illustrated embodiment, the force producing member is a powered linear actuator 104 which not only provides a force for outwardly pivoting the bottom arm 36 toward the extended position but also a force for pulling it back to the retracted position. A first counter-balance spring 106 and a second counter-balance spring 108 can be provided to reduce the force requirements of the actuator 104 as discussed in more detail hereinbelow. The powered linear actuator 104 is preferably an electric linear actuator. It is noted that the powered actuator 104 can be of alternative types such as, for example, a torsion actuator and can utilize alternative types of power such as, for example, mechanical, hydraulic, and pneumatic. A suitable electric linear actuator is Part Number LA 28.25 SR-400-24-02 available from LINAK Inc., Louisville, Ky. The actuator 104 of the illustrated embodiment is custom made with the desired length but alternatively an extension can be used to increase the length of a commercially-available standard-size actuator. Power for the actuator 104 can be provided by either the recreational vehicle power system or a separate independent power system and can be 24 VDC or preferably 12 VDC.

The actuator 104 is preferably mounted between the base arm 34 and the bottom arm 36. A first end of the actuator 104 is mounted to the base arm 34 by an upper mounting bracket 112. The upper mounting bracket 112 is secured to the side wall 43 of the base arm 34 at an upper portion thereof by any suitable manner such as, for example, rivets or screws. As best shown in FIG. 3B, the upper mounting bracket 112 is preferably an extrusion of a light weight, high strength material such as, for example, an aluminum alloy. The upper bracket 112 is preferably shaped to interlock with the base arm 34 and to have an outwardly directed flange 113.

In the illustrated embodiment, the upper mounting bracket 112 is secured slightly below the pivot joint between the base arm 34 and the top arm 40. A clevis 114 of the actuator 104 is pivotally connected to the flange 113 of the upper mounting bracket 112 in a suitable manner. The actuator 104 length of stroke and mounting position must be coordinated exactly with the 4-bar geometry of the arms 34, 36, 38, 40 so that they open and close properly.

A second end of the actuator 104 is mounted to the bottom arm 36 by a lower mounting bracket 116. As best shown in FIG. 3A, the lower mounting bracket 116 is preferably an extrusion of a light weight, high strength material such as, for example, an aluminum alloy. The lower mounting bracket 116 is preferably shaped to interlock with the bottom arm 36 and to have an outwardly directed flange 117.

The lower mounting bracket 116 is secured to the bottom arm 36 at a central or intermediate portion thereof by any suitable manner such as, for example, rivets or screws. The lower mounting bracket 116 is secured between the pivot joint between the base arm 34 and the bottom arm 36 and the pivot joint between the bottom arm 36 and the extended arm 38. A clevis 118 of the actuator extension 110 is pivotally connected to the lower mounting bracket 116 an any suitable manner. The side wall 43 of the base arm 34 is provided with a suitable cut-out or clearance opening 119 for the lower mounting bracket 116 when in the extended position.

Figure 7:
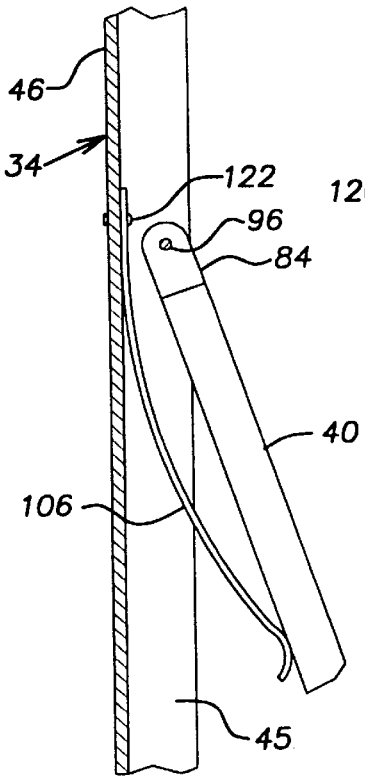
FIG. 7 is an enlarged and fragmented side elevational view, partially in cross section, showing a counter-balance spring of the awning assembly of FIG. 1.
Figure 8:
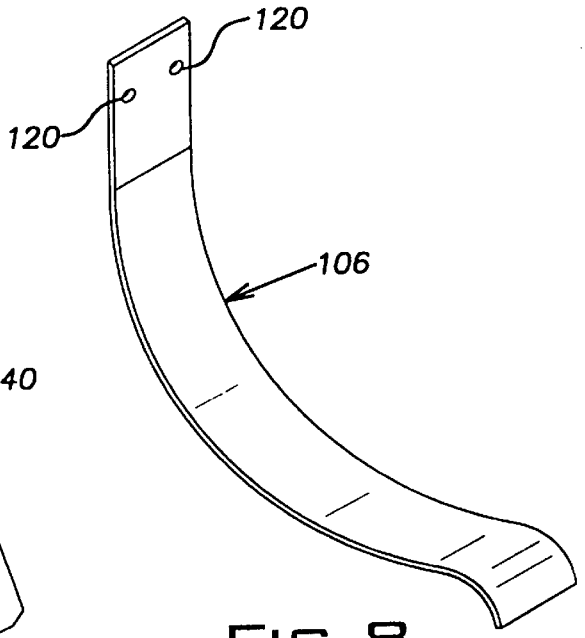
FIG. 8 is an enlarged perspective view of the counter-balance spring of FIG. 7.

As best shown in FIGS. 7 and 8, the first counter-balance spring 106 is preferably a compression, bowed leaf spring acting between the base arm 34 and the top arm 40 near the pivot joint between the base arm 34 and the top arm 40. The first counter-balance spring 106 has an upper end secured to the base arm 34 and a lower free end engaging the top arm 40. The upper end is provided with suitable openings 120 and is fastened to the base arm 34 with suitable fasteners 122 such as, for example, rivets or bolts. Mounted in this manner, the first counter-balance spring 106 applies a force which outwardly pivots the top arm 40 relative to the base arm 34.

The first counter-balance spring 106 is compressed when the top arm 40 is downwardly pivoted into the channel 45 of the base arm 34. In the retracted or flattened position, therefore, the single-leaf first counter-balance spring 106 stores energy which is at least partially released upon extension of the awning 10. The illustrated first counter-balance spring 106 is a variable rate spring which has its highest force output when the top arm 40 is near the fully retracted position. As the first counter-balance spring 106 is compressed, it flattens against the base arm 34 to gain support and avoid over stress. As the support moves down on the first counter-balance spring 106, the first counter-balance spring 106 gets shorter and stiffer to apply a higher force and improved assist for the actuator 104.

The first counter-balance spring 106 is sized to provide a force which balances the inward pull of the roller assembly torsion spring 28 which has relatively low leverage when in the extended position and relatively high leverage when in the retracted position. The torsion spring 28 has a high mechanical advantage as the awning 10 approaches the wall 12. The first counter-balance spring 106, however, develops a high force as it is compressed at the support wall 12 to counter the high force of the torsion spring 28. It should be noted that the actuator 104 has good mechanical advantage until it approaches the wall 12, where it needs help. The mounting brackets 112, 116 of the actuator 104 must be kept short, thus the poor leverage near the wall, so that the awning 10 is kept to a low profile in the retracted position. The first counter-balance spring 106, therefore, reduces the force requirements of the actuator 104 because the actuator 104 does not have to overcome the inward pull of the roller assembly torsion spring 28 when initially moving the awning 10 away from the support wall 12 to move the awning 10 from the retracted position (FIG. 2) to the extended position (FIG. 3).

Figure 9:
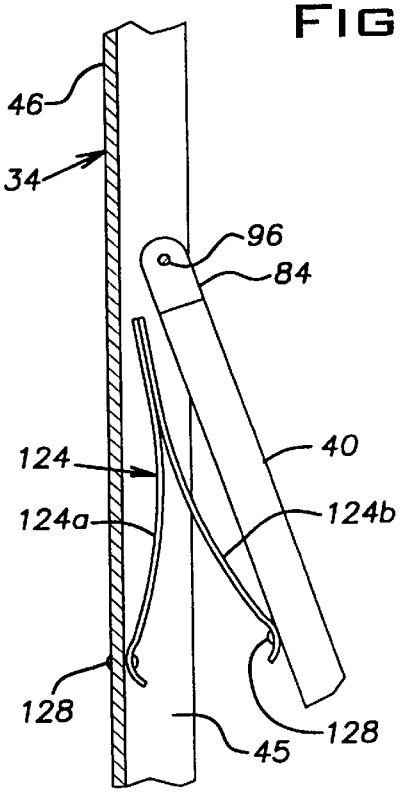
FIG. 9 is a side elevational view similar to FIG. 7 but showing an alternative counter-balance spring.
Figure 10:
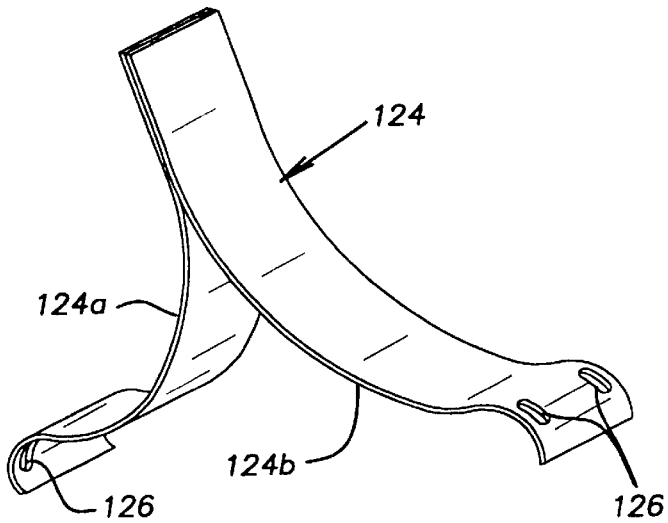
FIG. 10 is an enlarged perspective view of the counter-balance spring of FIG. 9.

FIGS. 9 and 10 illustrate an alternative first counter-balance spring 124 wherein a double leaf is utilized between the base arm 34 and the top arm 40 near the pivot joint between the base arm 34 and the top arm 40. The double-leaf spring 124 preferably, has an inner leaf 124*a* and an outer leaf 124*b* mounted as a back-to-back pair. The twin-leaf design provides a long stroke and high force yet retracts into a tight space. Each leaf 124*a*, 124*b* is generally arcuate having upper ends joined together and lower ends secured to the base arm 34 and top arm 40 respectively. The upper ends are joined in any suitable manner, such as for example, welding. The lower ends are provided with openings 126 and fastened with suitable fasteners 128 (FIG. 9) such as, for example, rivets or bolts to the base and top arms 34, 40. Mounted in this manner, the double-leaf first counter-balance spring 124 applies a force which outwardly pivots the top arm 40 relative to the base arm 34 with no sliding contact on the arms 34, 40.

The inner and outer leaves 124*a*, 124*b* are compressed toward each other when the top arm 40 is downwardly pivoted into the channel 45 of the base arm 34. The leaves 124*a*, 124*b* flatten against each other to support each other, to distribute stress, and to form a compact package. In the retracted or flattened position, the double-leaf first counter-balance spring 124 stores energy which is at least partially released upon extension of the awning 10. It should be noted that the configuration of single-leaf spring is simpler to produce and install. The single-leaf spring, however, has less stroke and greater stress than the twin-leaf spring and requires a suitable rub strip on the top arm 40 at the area of sliding contact.

The second counter-balance spring 108 is preferably a compression coil spring acting between the base arm 34 and the extended arm 38 above the pivot joint between the base arm 34 and the top arm 40. The second counter-balance spring 108 is preferably secured to the base arm 34 by a generally cylindrical spring base or guide 130. The spring base 130 is secured to the base arm 34 in any suitable manner such as, for example, screws. The free end of the second counter-balance spring 108 is preferably provided with a rubber bumper or guard 132. Mounted in this manner, the second counter-balance spring 108 applies a force to outwardly pivot the extended arm 38 relative to the base arm 34. It is noted that the second counter-balance spring 108 can alternatively be mounted on the top arm 40 to act between the top arm 40 and the extended arm 38 to outwardly rotate the extended arm 38. The second counter-balance spring 108, however, preferably engages the extended arm at the highest point possible so the torque arm is relatively large, thereby requiring a reduced spring force.

The second counter-balance spring 108 is sized to provide a force which offsets the increase in leverage of the roller assembly torsion spring 28 and the decrease in leverage of the actuator 104 as the extended arm 38 reaches the fully retracted position (best shown in FIG. 1). The second counter-balance spring 108, therefore, reduces the force requirements of the actuator 104 because an additional force is provided by the second counter-balance spring 108 when the torque arm of the actuator 104 is near its smallest length to help overcome the inward pull of the roller assembly torsion spring 28 when the actuator 104 is moving the awning 10 from the retracted position (FIG. 2) to the extended position (FIG. 3). The second counter-balance spring 108 is only required when the actuator 104 and the first counter-balance spring 106 are not able to move the awning 10 away from the wall and/or the first counter-balance spring 106 alone does not adequately reduce the force requirements of the actuator 104.

As best shown in FIGS. 1 and 1A, the top and bottom arms 36, 40 are stacked within the base and extended arms 34, 38 so that the awning 10 is in close relationship with the support wall 12 and the canopy 14 is fully rolled-up on the roller assembly 16 when the awning 10 is the retracted position. The base arm 34 and the extended arm 38 each have a substantially parallel relationship with the support wall 12 of the recreational vehicle. The bottom arm 36 and the top arm are each located partially within the base arm 34 and partially within the extended arm 38. The first counter balance spring 106 is compressed between the base arm 34 and the top arm 40 and the second counter-balance spring 108 is compressed between the base arm 34 and the extended arm 38. In this retracted position, the inactivated actuator 104 is locked to prevent movement of the arms 36, 38, 40. A suitable travel lock may also be provided to secure the arms 36, 38, 40 in their retracted positions if desired.

To open the awning 10, the operator manually unlocks the roller assembly lock if provided to permit the canopy 14 to unroll from the roller assembly 16 and manually unlocks the travel lock if provided to permit the arms 36, 38, 40 to open. The operator then activates the actuator 104 so that power is provided thereto and the actuator 104 begins to decrease in length. As the length of the actuator 104 decreases, the bottom arm 36 is upwardly rotated about its pivot joint with the base arm 34.

As best shown in FIG. 2, the rotation of the bottom arm 36 and the resulting rotation of the top arm 40, downwardly rotates the extended arm 38 about its pivot joint with the bottom arm 36. As the top end of the extended arm 38 moves away from the wall 12, the canopy 14 is unrolled from the roller assembly 16.

Initially, both the first and second counter-balance springs 106, 108 each assist the actuator 104 by supplying forces which balance the bias of the torsion spring of the roller assembly 16. Once the extended arm 38 is no longer in contact with the second counter-balance spring 108 and the actuator 104 has an increased torque arm, the first counter balance spring 106 acts alone to balance the bias of the torsion spring of the roller assembly 16.

As best shown in FIG. 3, the actuator 104 continues to decrease in length until the extended arm 38 is generally an extension of the bottom arm 36, that is, the extended arm 38 and the bottom arm 36 are generally coaxial. The actuator 104 then stops and locks. In this position, the canopy 14 is fully extended and the awning 10 is in the deployed position. In this deployed position, the inactivated actuator 104 prevents inward movement of the arms 36, 38, 40. Suitable locks may also be provided to further secure the arms 36, 38, 40 in their deployed positions if desired.

To close the awning 10, the operator manually unlocks the roller assembly lock if provided to permit the canopy 14 to roll onto the roller assembly 16 and manually unlocks any additional locks if provided to permit the arms 36, 38, 40 to close. The operator then activates the actuator 104 so that power is provided thereto and the actuator 104 begins to increase in length. As the length of the actuator 104 increases, the bottom arm 36 is downwardly rotated about its pivot joint with the base arm 34.

As best shown in FIG. 2, the rotation of the bottom arm 36 and the resulting rotation of the top arm 40, upwardly rotates the extended arm 38 about its pivot joint with the bottom arm 36. As the top end of the extended arm 38 moves toward the wall 12, the canopy 14 is rolled back onto the roller assembly 16 by a slow and even movement. It is noted that the torsion spring provides a force which rotates the roller assembly 16 but is offset by the counter-balance springs 106, 108 so that the actuator 104 controls the rate of movement of the awning 10.

As best shown in FIG. 1, the actuator 104 continues to increase in length until the extended arm 38 is generally parallel with the base arm 34 and the wall 12. The actuator 104 then stops with the arms 34, 36, 38, 40 tight against the wall. In this position, the canopy 14 is fully furled up and the awning 10 is in the retracted position. The operator then locks the travel locks if provided.

FIGS. 11 to 14 illustrate a second embodiment of a retractable awning 140 according to the present invention wherein like reference numbers are used for like structure. The awning 140 is a spring-assisted manual awning which is attached to a vertically-extending support wall 12 such as the side of a recreational vehicle.

Figure 18:
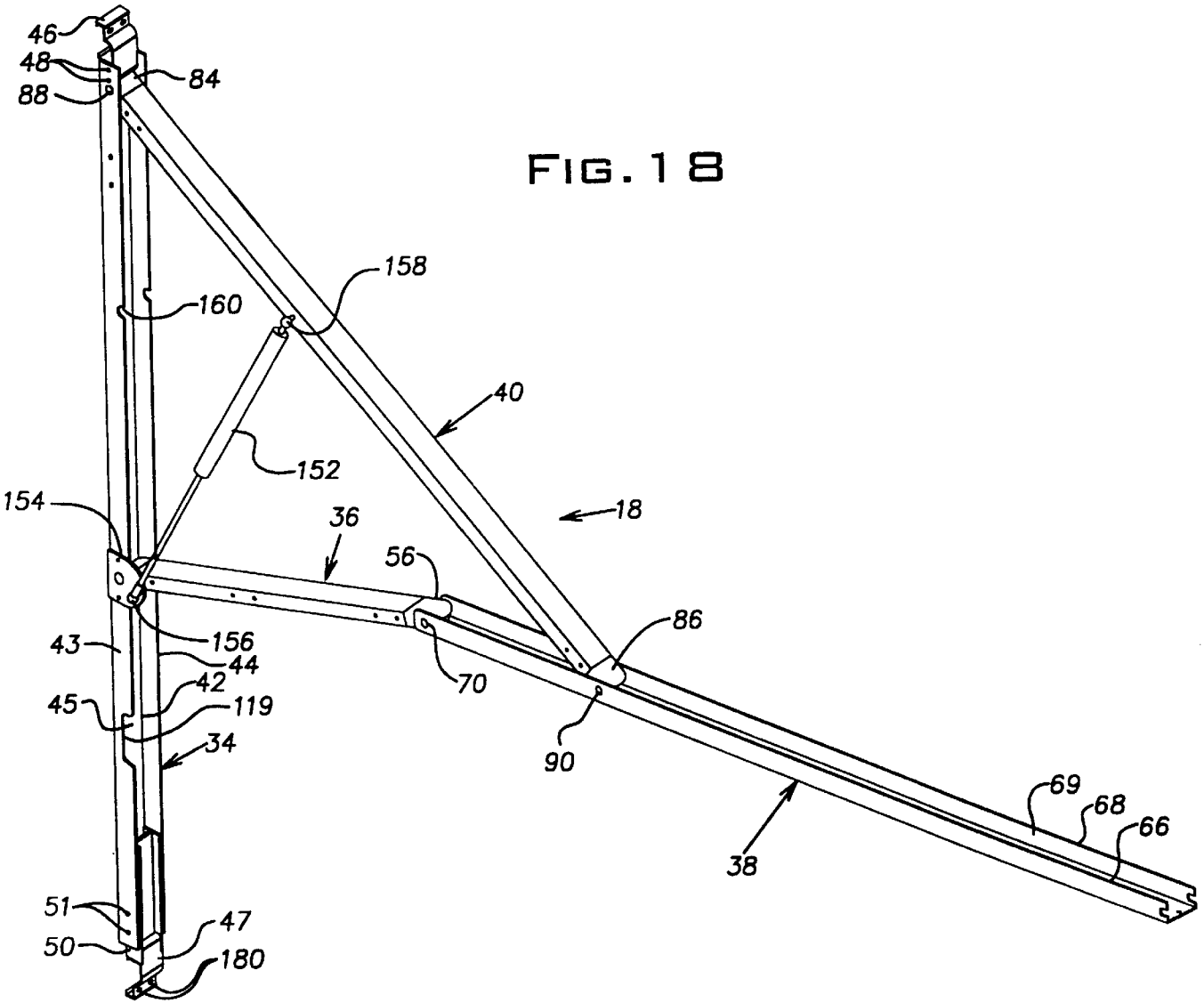
FIG. 18 is an enlarged perspective view of a spring-assisted arm assembly of the awning assembly of FIGS. 15 to 17 in the fully extended position.

The awning 140 according to the second embodiment of the present invention is substantially the same as the awning according to the first embodiment of the present invention except that the force producing member for outwardly pivoting the bottom arm 36 toward the extended position is a spring 142. The spring 142 is a tension coil spring but other suitable springs can be utilized such as, for example, a gas spring or a suitably configured assembly with compression coil spring or a compression gas spring (see FIGS. 14A and 18 for examples of suitable configurations for compression springs). It is noted that the awning 140 also does not include the first or second counter-balance springs 106, 108, discussed with regard to the first embodiment, because the operator already has good mechanical advantage when pulling.

The spring 142 is mounted between the base arm 34 and the bottom arm 36. A first end of the spring 142 is mounted to the base arm 34 by the upper mounting bracket 112. An end loop 144 of the spring 142 is pivotally connected to the upper mounting bracket 112 an any suitable manner. A second end of the spring 142 is mounted to the bottom arm 36 by the lower mounting bracket 116. A second end loop 146 of the spring 142 is pivotally connected to the lower mounting bracket 116 an any suitable manner.

The spring 142 is positioned and sized to counterbalance the torsion spring 28 of the roller assembly 16. As noted above with regard to the first embodiment, there is an increase in leverage of the roller assembly torsion spring 28 and the decrease in leverage of the spring 142 as the extended arm 38 moves toward the retracted position (best shown in FIG. 11) but the operator has good leverage here. Also, there is a decrease in leverage of the roller assembly torsion spring 28 and the increase in leverage of the spring 142 as the extended arm 38 moves toward the extended position (best shown in FIG. 13) and the operator needs help here. As the awning 140 is extended, stored energy in the spring 142 assists deployment and is transferred to the torsion spring 28 of the roller assembly 16. As the awning 140 is retracted, stored energy in the torsion spring 28 of the roller assembly 16 assists retraction and is transferred to the assist spring 142.

Figure 11:
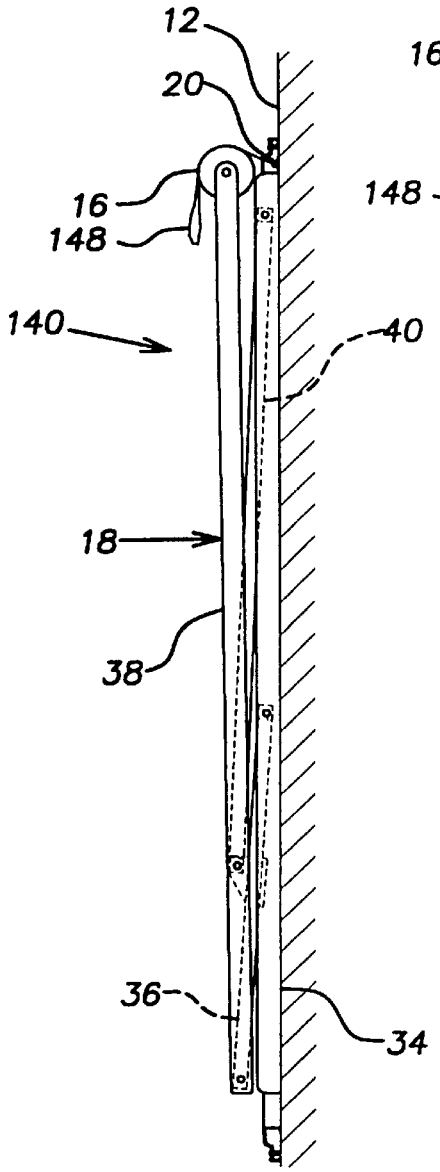
FIG. 11 is a side elevational view of a spring-assisted manual awning according to the present invention in a stored or retracted position and having a coil tension spring.

Because the awning 140 is a manual awning, the roller assembly 16 includes a pull strap 148. The pull strap 148 is preferably secured to one of the grooves of the roller tube 22 in a known manner. The pull strap 148 wraps around the roller tube 22 within the canopy 14 when the canopy 14 is rolled-up on the roller tube 22 so that a looped end slightly extends out of the canopy 14 when the canopy 14 is fully rolled-up onto the roller tube 22 (FIG. 11).

To open the awning 140, the operator manually unlocks the roller assembly 16 to permit the canopy 14 to unroll from the roller assembly 16 and manually unlocks the travel lock. The operator grasps the awning pull strap 148 and pulls to move the roller assembly 16 away from the support wall 12 and unroll the canopy from the roller assembly 16.

Figure 12:
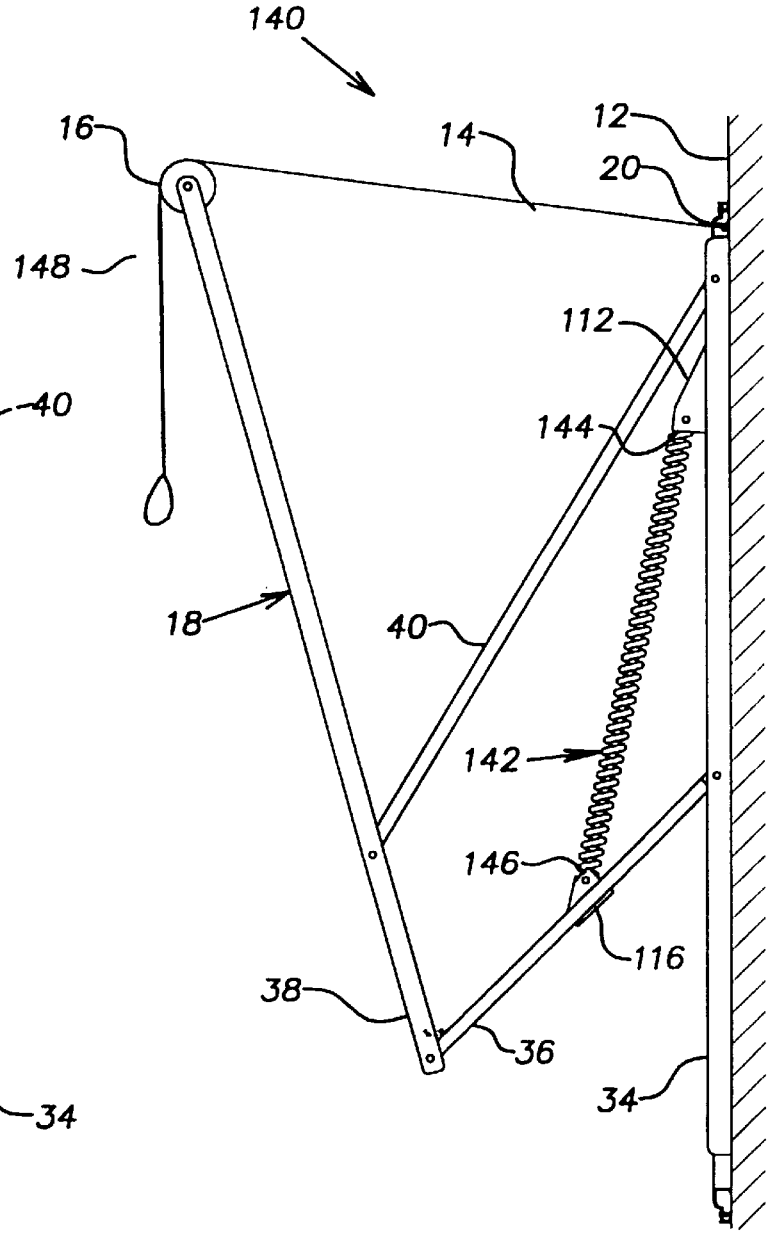
FIG. 12 is a side elevational view of the awning of FIG. 11 in a partially deployed or extended position.

As best shown in FIG. 12, the rotation of the bottom arm 36 and the resulting rotation of the top arm 40, downwardly rotates the extended arm 38 about its pivot joint with the bottom arm 36. As the top end of the extended arm 38 moves away from the wall 12, the canopy 14 is unrolled from the roller assembly 16. As the bottom arm 36 is upwardly rotated about its pivot joint with the base arm 34 the leverage of the spring 142 increases and assists deployment by supplying a force which counter-balances the torsion spring 28 of the roller assembly 16.

Figure 13:
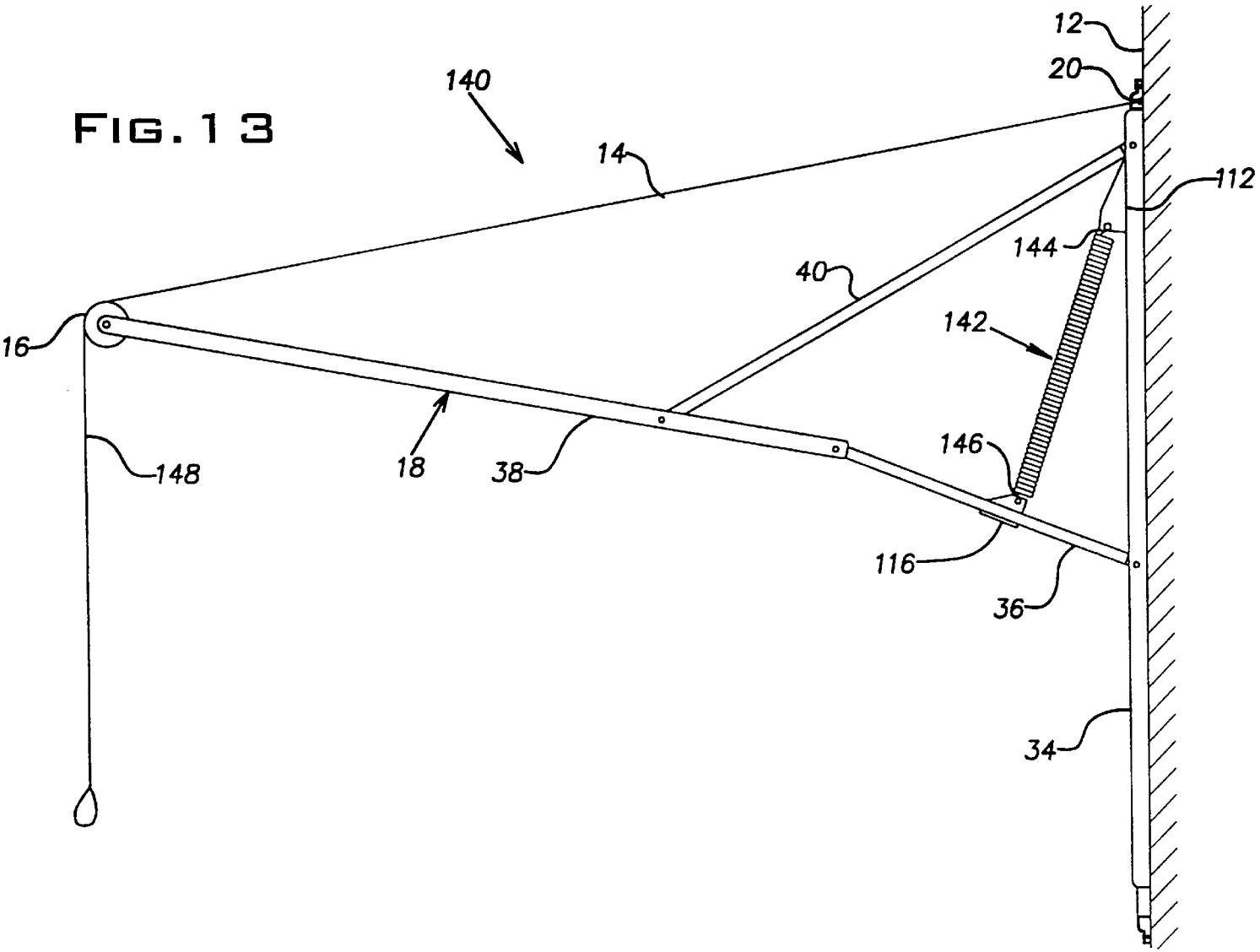
FIG. 13 is a side elevational view of the awning of FIGS. 11 and 12 in a fully deployed or extended position.
Figures 14, 14A:
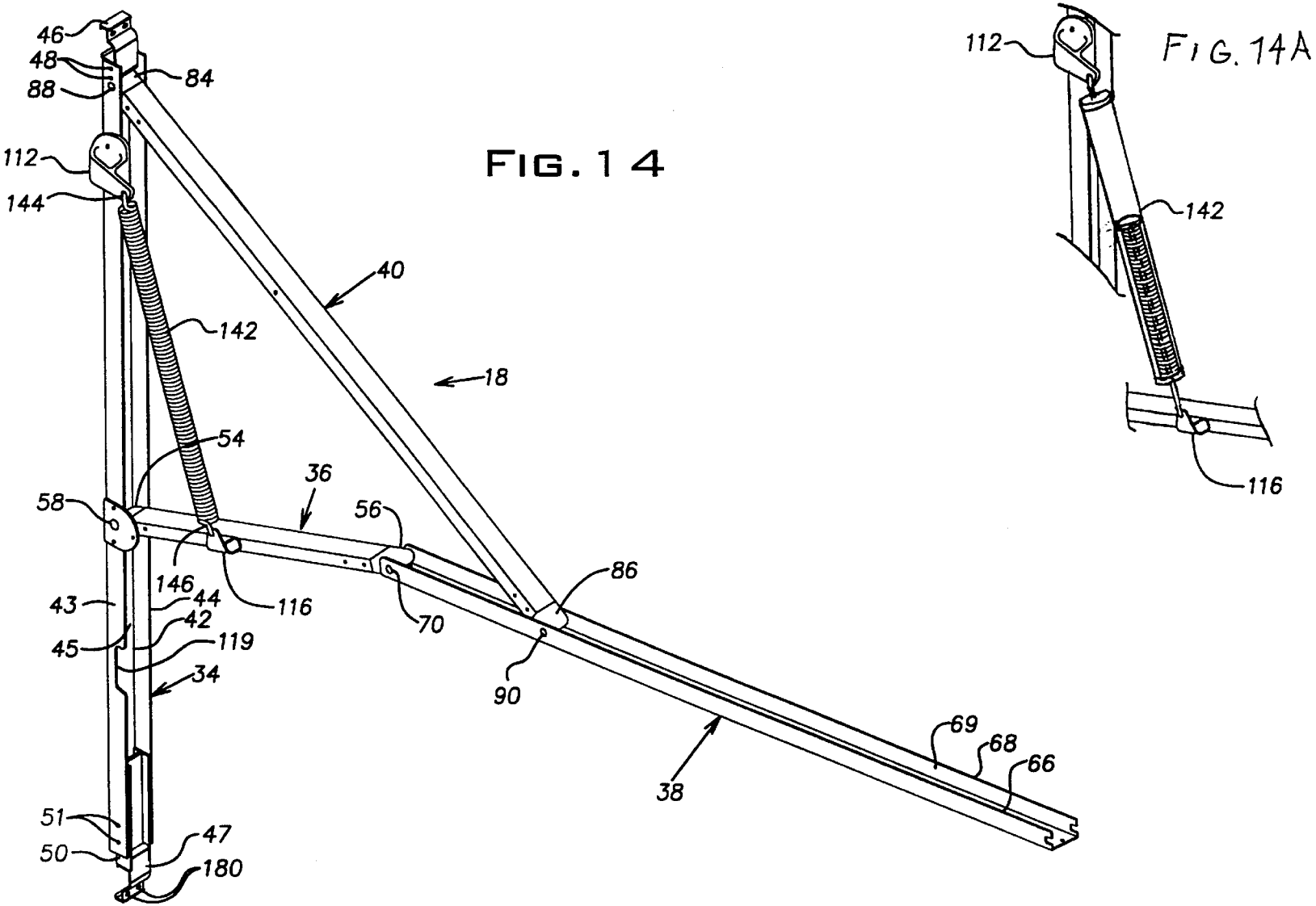
FIG. 14 is an enlarged perspective view of a spring-assisted arm assembly of the awning assembly of FIGS. 11 to 13 in the fully extended position.
FIG. 14A is a fragmented view showing a variant of the spring-assisted arm assembly of FIG. 14.

As best shown in FIG. 13, the spring continues to decrease in length until the extended arm 38 is generally an extension of the bottom arm 36, that is, the extended arm 38 and the bottom arm 36 are generally coaxial. The spring 142 is then unloaded or nearly unloaded. In this position, the canopy 14 is fully extended and the awning 10 is in the deployed position. In this deployed position, the spring 142 pulls upwardly lightly on the bottom arm 36, the canopy 14 pulls tight between the awning rail 20 and the roller assembly 16, and the roller assembly lock prevents the canopy 14 from rolling back into the roller assembly 16. A suitable additional lock may also be provided to secure the arms 36, 38, 40 in their deployed positions if desired.

To close the awning 10, the operator grasps the pull strap and manually unlocks the roller assembly 16, and manually unlocks any additional locks if provided, to permit the canopy 14 to roll onto the roller assembly 16. The bias provided by the torsion spring 28 rolls the canopy onto the roller assembly 16 and pulls the roller assembly 16 toward the wall 12. As the roller assembly 16 moves toward the wall 12, the bottom arm 36 is downwardly rotated about its pivot joint with the base arm 34 and the length of the spring 142 is increased to store energy therein for later deployment.

As best shown in FIG. 12, the rotation of the bottom arm 36 and the resulting rotation of the top arm 40, upwardly rotates the extended arm 38 about its pivot joint with the bottom arm 36. As the top end of the extended arm 38 moves toward the wall 12, the canopy 14 is rolled back onto the roller assembly 16.

As best shown in FIG. 11, the torsion spring 28 rotates the awning 10 until the extended arm 38 is generally parallel with the base arm 34 and the support wall 12. In this position, the canopy 14 is fully furled up and the awning 10 is in the retracted position. The operator then locks the travel lock if provided to prevent outward movement of the arms 36, 38, 40.

FIGS. 15 to 18 illustrate a third embodiment of a retractable awning 150 according to the present invention wherein like reference numbers are used for like structure. The awning 150 is a spring-assisted manual awning which is attached to a vertically-extending support wall 12 such as the side of a recreational vehicle.

The awning 150 according to the third embodiment of the present invention is substantially the same as the awning 140 according to the second embodiment of the present invention except that the force producing member is a compression gas spring 152. A suitable gas spring is available from Suspa, Inc., Grand Rapids, Mich. The spring 152 illustrates that configurations with compression springs can be utilized and that other types of springs such as gas springs can be utilized. It is noted that the awning 150 also does not include the first or second counter-balance springs 106, 108 discussed with regard the first embodiment because, as with the second embodiment, the operator already has good mechanical advantage when pulling.

Because the spring 152 is a compression spring, it is mounted between the base arm 34 and the top arm 40. A first end of the spring 152 is mounted to the base arm 34 by a mounting bracket 154. The mounting bracket 154 is secured to the side wall 43 of the base arm 34 at an intermediate portion thereof by any suitable manner such as, for example, rivets or screws. In the illustrated embodiment, the lower mounting bracket 154 is secured at the pivot joint between the base arm 34 and the bottom arm 36. The spring 152 is provided with pivotable ball end joints 156, 158. A second end of the spring 152 is mounted to the top arm 40 at a central or intermediate portion thereof by any suitable manner such as, for example, a threaded stud of the end joint 158. The side wall 43 of the base arm 34 is provided with a suitable cut out or clearance opening 160 for the end joint when in the retracted position.

In the illustrated awning 150, the spring 152 is mounted with the cylinder portion secured to the top arm 40 and the rod portion secured to the base arm 34. It is noted, however, that the spring can alternatively be mounted in the reverse orientation, that is, with the rod portion secured to the top arm 40 and the cylinder portion secured to the base arm 34. This reverse orientation may be particularly advantageous when the awning 150 is secured to a recreational vehicle to protect against road splash.

The spring 152 is positioned and sized to counterbalance the torsion spring 28 of the roller assembly 16. As noted above with regard to the first and second embodiments, there is an increase in leverage of the roller assembly torsion spring 28 and the decrease in leverage of the spring 142 as the extended arm 38 moves toward the retracted position (best shown in FIG. 15) but the operator has good leverage here. Also, there is a decrease in leverage of the roller assembly torsion spring 28 and the increase in leverage of the spring 142 as the extended arm 38 moves toward the extended position (best shown in FIG. 17) and the operator needs help here. As the awning 140 is extended, stored energy in the spring 152 assists deployment and is transferred to the torsion spring 28 of the roller assembly 16. As the awning 150 is retracted, stored energy in the torsion spring 28 of the roller assembly 16 assists retraction and is transferred to the spring 152.

To open the awning 150, the operator manually unlocks the roller assembly 16 to permit the canopy 14 to unroll from the roller assembly 16 and manually unlocks the travel lock. The operator grasps the awning pull strap 148 and pulls to move the roller assembly 16 away from the support wall 12 and unroll the canopy from the roller assembly 16.

Figure 16:
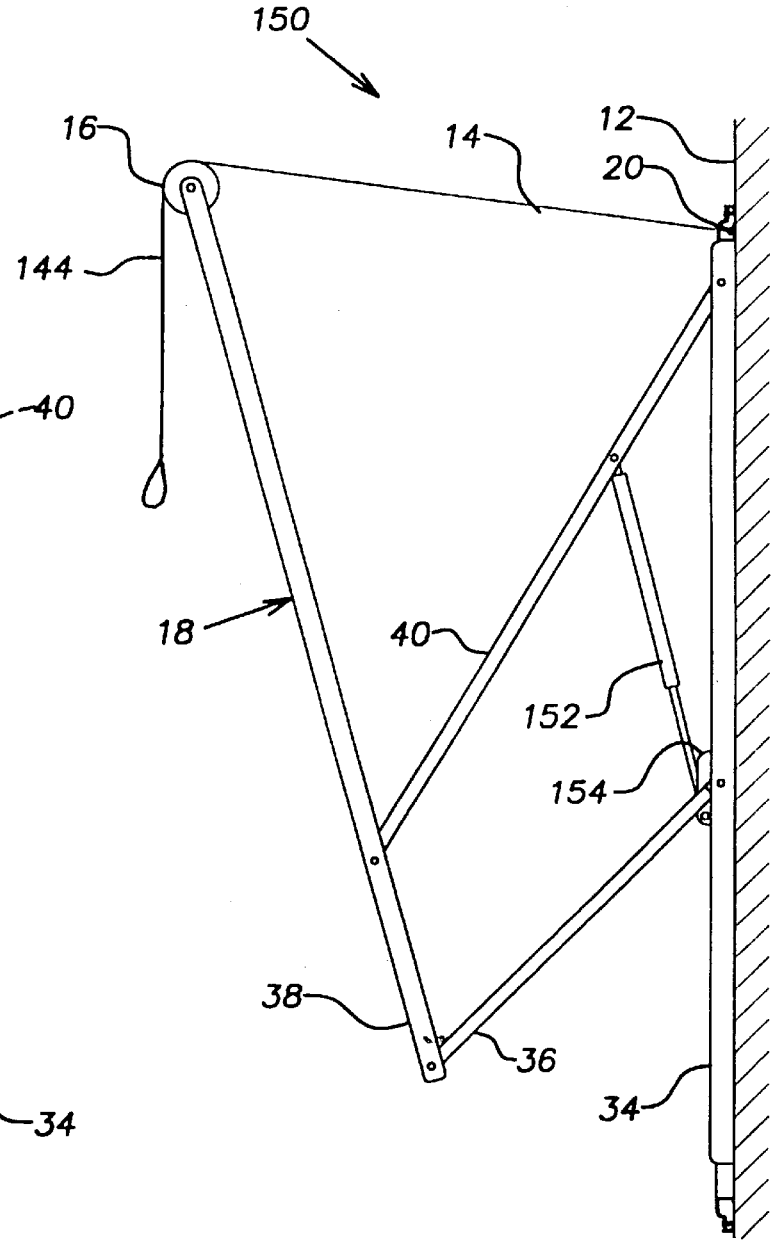
FIG. 16 is a side elevational view of the awning of FIG. 15 in a partially deployed or extended position.

As best shown in FIG. 16, the rotation of the top arm 40 and the resulting rotation of the bottom arm 36, downwardly rotates the extended arm 38 about its pivot joint with the bottom arm 36. As the top end of the extended arm 38 moves away from the wall 12, the canopy 14 is unrolled from the roller assembly 16. As the top arm 40 is upwardly rotated about its pivot joint with the base arm 34 the leverage of the spring 152 increases and assists deployment by supplying a force which counter-balances the torsion spring 28 of the roller assembly 16.

Figure 17:
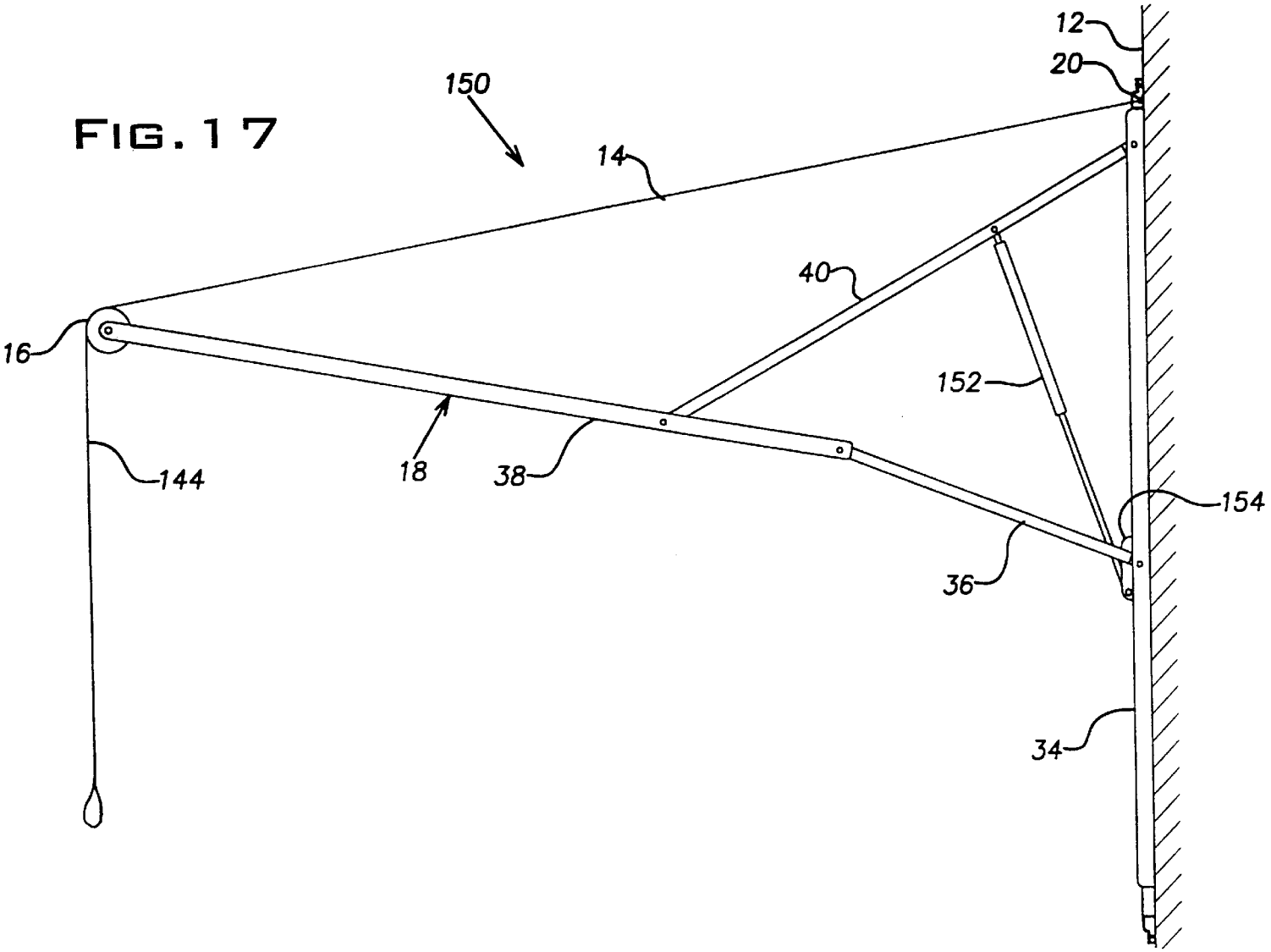
FIG. 17 is a side elevational view of the awning of FIGS. 15 and 16 in a fully deployed or extended position.

As best shown in FIG. 17, the spring continues to increase in length until the extended arm 38 is generally an extension of the bottom arm 36, that is, the extended arm 38 and the bottom arm 36 are generally coaxial. The spring 152 is then unloaded or nearly unloaded. In this position, the canopy 14 is fully extended and the awning 10 is in the deployed position. In this deployed position, the spring 152 pushes upwardly lightly on the top arm 40, the canopy 14 pulls tight between the awning rail 20 and the roller assembly 16, and the roller assembly lock prevents the canopy 14 from rolling back onto the roller assembly 16. A suitable additional lock may also be provided to secure the arms 36, 38, 40 in their deployed positions if desired.

To close the awning 10, the operator grasps the pull strap 148 and manually unlocks the roller assembly 16, and manually unlocks any additional locks if provided, to permit the canopy 14 to roll onto the roller assembly 16. The bias provided by the torsion spring 28 rolls the canopy onto the roller assembly 16 and pulls the roller assembly 16 toward the wall 12. As the roller assembly 16 moves toward the wall 12, the top arm 40 is downwardly rotated about its pivot joint with the base arm 34 and the length of the spring 152 is decreased to store energy therein for later deployment.

As best shown in FIG. 16, rotation of the top arm 40 and the resulting rotation of the bottom arm 36, upwardly rotates the extended arm 38 about its pivot joint with the bottom arm 36. As the top end of the extended arm 38 moves toward the wall 12, the canopy 14 is rolled back onto the roller assembly 16.

Figure 15:
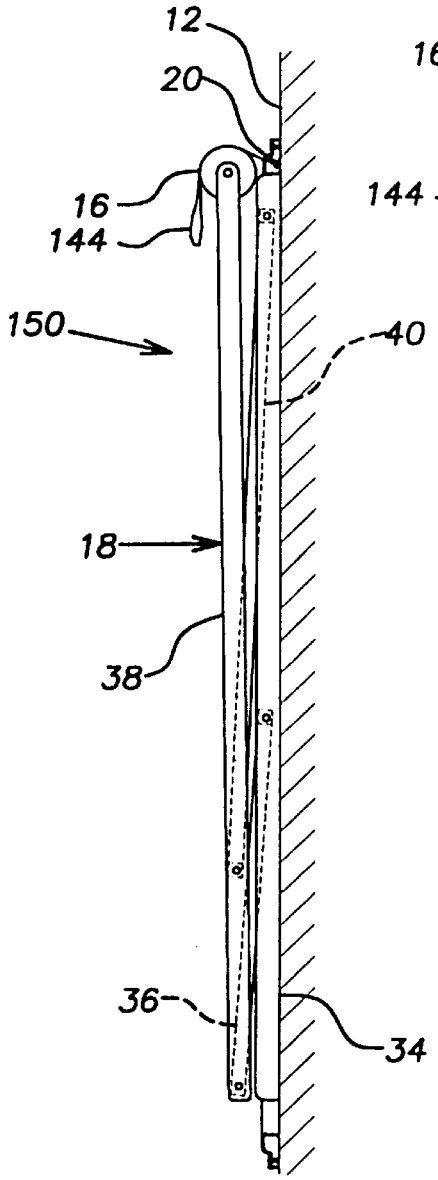
FIG. 15 is a side elevational view of another spring-assisted manual awning according to the present invention in a stored or retracted position and having a gas compression spring.

As best shown in FIG. 15, the torsion spring 28 rotates the awning 10 until the extended arm 38 is generally parallel with the base arm 34 and the wall 12. In this position, the canopy 14 is fully furled up and the awning 10 is in the retracted position. The operator then locks the travel lock if provided to prevent outward movement of the arms 36, 38, 40.

Although particular embodiments of the invention have been described in detail, it will be understood that the invention is not limited correspondingly in scope, but includes all changes and modifications coming within the spirit and terms of the claims appended hereto.

What is claimed is:

1. A retractable awning for mounting to a wall, said awning comprising:

a roller assembly including a torsion spring biasing said roller assembly toward a retracted position adjacent the wall;

a flexible canopy having an inner edge for connection to the wall and an outer edge secured to said roller assembly; and a pair of arm assemblies supporting opposite ends of said roller assembly and operable to move said roller assembly between the retracted position adjacent the wall and an extended position spaced from the wall, each, of said arm assemblies including a vertically extending base arm for connection to the wall, a bottom arm having a first end pivotally connected to said base arm, an extended arm having a first end pivotally connected to said bottom arm and a second end connected to and supporting said roller assembly, a top arm having a first end pivotally connected to said base arm above said bottom arm and a second end pivotally connected to said extended arm, and a force producing member extending between said base arm and one of said bottom arm and said top arm for outwardly pivoting said bottom arm, said extended arm, and said top arm toward the extended position; and a counter-balance spring engaging said top arm in the retracted position and biasing said top arm toward the extended position to at least partially counter-balance forces produced by said torsion spring.

2. The retractable awning according to claim 1, wherein said force producing member is a powered actuator.

3. The retractable awning according to claim 2, wherein said powered actuator is an electric linear actuator.

4. The retractable awning according to claim 1, wherein said counter-balance spring is a leaf spring located between said top arm and said base arm.

5. The retractable awning according to claim 4, wherein said counter-balance spring is a double-leaf spring.

6. The retractable awning according to claim 1, wherein said force producing member is a spring.

7. The retractable awning according to claim 6, wherein said spring is a coil spring.

8. The retractable awning according to claim 6, wherein said spring is a tension spring extending between said base arm and said bottom arm.

9. The retractable awning according to claim 6, wherein said spring is a gas spring extending between said base arm and said top arm.

10. The retractable awning according to claim 6, wherein said spring is a compression spring extending between said base arm and said top arm.

11. The retractable awning according to claim 6, wherein said spring is a compression spring extending between said base arm and said bottom arm and mounted to produce tension.

12. A retractable awning for mounting to a wall, said awning comprising:

a roller assembly including a torsion spring;

a flexible canopy having an inner edge for connection to the wall and an outer edge secured to said roller assembly; and a pair of arm assemblies supporting opposite ends of said roller assembly and operable to move said roller assembly between a retracted position adjacent the wall and an extended position spaced from the wall, said torsion spring of said roller assembly biasing said roller assembly toward the retracted position, each of said arm assemblies including a vertically extending base arm for connection to the wall, a bottom arm having a first end pivotally connected to said base arm, an extended arm having a first end pivotally connected to said bottom arm and a second end connected to and supporting said roller assembly, a top arm having a first end pivotally connected to said base arm above said bottom arm and a second end pivotally connected to said extended arm, and a counter-balance spring biasing said arm assembly toward the extended position and at least partially counter-balancing forces produced by said torsion spring when said arm assemblies are near the retracted position;

wherein said counter-balance spring engages said top arm at least in the retracted position and directly biases said top arm toward the extended position.

13. The retractable awning according to claim 12, wherein said counter-balance spring is a leaf spring located between said top arm and said base arm.

14. The retractable awning according to claim 13, where in said counter-balance spring is a double-leaf spring.

15. The retractable awning according to claim 12, wherein said counter-balance spring is secured to said base arm.

16. The retractable awning according to claim 12, wherein said counter-balance spring is a compression coil spring.

17. The retractable awning according to claim 12, further comprising a force producing member extending between said base arm and one of said bottom arm and said top arm for outwardly pivoting said bottom arm, said extended arm, and said top arm toward the extended position.

18. The retractable awning according to claim 17, wherein said force producing member is a powered actuator.

19. The retractable awning according to claim 18, wherein said linear actuator is a linear actuator.

20. An automatic awning for mounting to a wall, said automatic awning comprising:

a roller assembly including a torsion spring;

a flexible canopy having an inner edge for connection to the wall and an outer edge secured to said roller assembly; and a pair of arm assemblies supporting opposite ends of said roller assembly and operable to move said roller assembly between a retracted position adjacent the wall and an extended position spaced from the wall, said torsion spring of said roller assembly biasing said roller assembly toward the retracted position, each of said arm assemblies including a vertically extending base arm for connection to the wall, a bottom arm having a first end pivotally connected to said base arm, an extended arm having a first end pivotally connected to said bottom arm and a second end connected to and supporting said roller assembly, a top arm having a first end pivotally connected to said base arm above said bottom arm and a second end pivotally connected to said extended arm, a powered actuator extending between said base arm and said bottom arm for pivoting said bottom arm between the retracted position and the extended position, said powered actuator providing a force for pivoting the bottom arm toward the extended position and an oppositely-directed force for moving the bottom arm to the retracted position, and a counter-balance spring biasing said arm assembly toward the extended position and at least partially counter-balancing forces generated by said torsion spring.

21. The automatic awning according to claim 20, wherein said powered actuator is a linear actuator.

22. The automatic awning according to claim 21, wherein said powered actuator is an electric linear actuator.

23. The automatic awning according to claim 20, wherein said counter-balance spring engages said top arm at least in the retracted position and biases said top arm toward the extended position.

24. The automatic awning according to claim 20, wherein said counter-balance spring is a leaf spring located between said top arm and said base arm.

25. The automatic awning according to claim 20, wherein said counter-balance spring is a double-leaf spring.

26. The automatic awning according to claim 20, wherein said counter-balance spring is secured to said base arm.

27. The automatic awning according to claim 20, wherein said counter-balance spring is a compression coil spring.

28. A retractable awning for mounting to a wall, said awning comprising:

a roller assembly;

a flexible canopy having an inner edge for connection to the wall and an outer edge secured to said roller assembly; and a pair of arm assemblies supporting opposite ends of said roller assembly and operable to move said roller assembly between a retracted position adjacent the wall and an extended position spaced from the wall, each of said arm assemblies including a vertically extending base arm for connection to the wall, a bottom arm having a first end pivotally connected to said base arm, an extended arm having a first end pivotally connected to said bottom arm and a second end connected to and supporting said roller assembly, a top arm having a first end pivotally connected to said base arm above said bottom arm and a second end pivotally connected to said extended arm, a base arm extension telescopically cooperating with said base arm such that a length of said base arm and said base arm extension are adjustable, an upper mounting bracket rigidly attached by fasteners to an upper end of said base arm, and a lower mounting bracket rigidly attached by fasteners to a bottom end of said base arm extension.

29. The retractable awning according to claim 28, wherein said base arm and said base arm extension are interlocked.

30. The retractable awning according to claim 28, wherein said base arm extension extends from a bottom end of said base arm.

31. The retractable awning according to claim 28, wherein said base arm is generally channel-shaped in cross-section and said base arm extension is generally H-shaped in cross-section.

* * * * *

UNITED STATES PATENT AND TRADEMARK OFFICE

CERTIFICATE OF CORRECTION

PATENT NO. : 6,095,221

DATED : August 1, 2000

INVENTOR(S) : Frey, Jr.

It is certified that error appears in the above-indentified patent and that said Letters Patent is hereby corrected as shown below:

On Title Page, Section [56], References Cited, FOREIGN PATENT DOCUMENTS, delete "55187 9/1938 United Kingdom", and insert --55187 9/1938 Denmark--.

Signed and Sealed this

Tenth Day of April, 2001

*Attest:*

Nicholas P. Godici

NICHOLAS P. GODICI

*Attesting Officer*

*Acting Director of the United States Patent and Trademark Office*